US006712701B1

(12) United States Patent
Boylan, III et al.

(10) Patent No.: US 6,712,701 B1
(45) Date of Patent: Mar. 30, 2004

(54) ELECTRONIC BOOK INTERACTIVE WAGERING SYSTEM

(75) Inventors: Peter C. Boylan, III, Tulsa, OK (US); Masood Garahi, Superior, CO (US); Richard E. McNutt, Lafayette, CO (US); John R. Hindman, Los Angeles, CA (US); William L. Thomas, Bixby, OK (US); Connie T. Marshall, Muskogee, OK (US); Douglas V. Ramsey, Louisville, CO (US)

(73) Assignee: ODS Technologies, L.P., Los Angeles, CA (US)

( * ) Notice: Subject to any disclaimer, the term of this patent is extended or adjusted under 35 U.S.C. 154(b) by 0 days.

(21) Appl. No.: 09/642,967

(22) Filed: Aug. 21, 2000

Related U.S. Application Data

(60) Provisional application No. 60/186,267, filed on Mar. 1, 2000.

(51) Int. Cl.[7] ..... A63F 9/22

(52) U.S. Cl. ..... 463/42; 700/93

(58) Field of Search ..... 463/25, 28, 30, 463/40–43; 455/3.01–3.06, 412; 348/14.01–14.05, 906; 725/32, 34, 37, 39, 40, 43, 46, 47, 50–61, 86–89, 100, 105, 109, 110, 135, 130–142

(56) References Cited

U.S. PATENT DOCUMENTS

| | | | | |
|---|---|---|---|---|
| 3,909,002 A | 9/1975 | Levy | ..... | 273/138 A |
| 4,033,588 A | 7/1977 | Watts | ..... | 273/138 A |
| 4,108,361 A | 8/1978 | Krause | ..... | 235/375 |

(List continued on next page.)

FOREIGN PATENT DOCUMENTS

| | | | | |
|---|---|---|---|---|
| EP | 0 387 046 A2 | 9/1990 | ..... | G07F/7/02 |
| EP | 0 583 196 A1 | 2/1994 | ..... | H04N/7/173 |
| EP | 0 620 688 A2 | 10/1994 | ..... | H04N/7/14 |

(List continued on next page.)

OTHER PUBLICATIONS

US 5,823,877, 10/1998, Scagnelli et al. (withdrawn)

Bienz et al., Portable Document Format Reference Manual, Version 1.2, pp. 17–35, 118–130, <http://pdfzone.com/pdfs/pdfspec.pdf> Adobe Systems, Inc. (Nov. 27, 1996).*

IBM Technical Disclosure Bulletin, *Electronic Book Display*, vol. 34, No. 7A, Dec. 1991, pp. 40–41.

You Bet Help File, Youbet.com, Inc., Los Angeles, California, last modified Jul. 11, 1998, pp. 1–132.

Maury Wolff, "Interactive Wagering A Good Bet," Daily Racing Form, Jan. 29, 1995, p. 4.

John Burgess, "And We're Off To The Races!" The Washington Post, Jan. 16, 1995, pp. 17–18.

(List continued on next page.)

*Primary Examiner*—Mark Sager
*Assistant Examiner*—Steven Ashburn
(74) *Attorney, Agent, or Firm*—Fish & Neave; Andrew Van Court

(57) ABSTRACT

An interactive wagering system is provided in which users may download electronic racing forms to electronic books. The content of the racing form may be directed toward horse racing. The racing form may be interactive. When a user selects an item from a racing form displayed on the electronic book, the user may be presented with additional information or interactive screens that provide racing-related services such as interactive wagering opportunities. The electronic book may be provided with updated racing data. The user may adjust delivery settings for the racing data. News flashes and other real-time reports may be provided to the electronic book. Such reports may be based on the user's preferences and the user's monitored interests. The electronic racing form may include racing data, racing articles, and advertisements.

144 Claims, 16 Drawing Sheets

U.S. PATENT DOCUMENTS 4,322,612 A 3/1982 Lange ..... 235/419
4,339,798 A 7/1982 Hedges et al. ..... 364/412
4,372,558 A 2/1983 Shimamoto et al. ..... 273/238
4,494,197 A 1/1985 Troy et al. ..... 364/412
4,593,904 A 6/1986 Graves ..... 273/1 E
4,636,951 A 1/1987 Harlick ..... 364/412
4,652,998 A 3/1987 Koza et al. ..... 364/412
4,689,742 A 8/1987 Troy et al. ..... 364/412
4,694,490 A 9/1987 Harvey et al. ..... 380/234
4,704,725 A 11/1987 Harvey et al. ..... 380/9
4,706,121 A 11/1987 Young ..... 358/142
4,745,468 A 5/1988 Von Kohorn ..... 358/84
4,747,600 A 5/1988 Richardson ..... 273/269
4,760,527 A 7/1988 Sidley ..... 364/412
4,764,666 A 8/1988 Bergeron ..... 235/380
4,799,683 A 1/1989 Bruner, Jr. ..... 273/138 A
4,815,741 A 3/1989 Small ..... 273/138 A
4,882,473 A 11/1989 Bergeron et al. ..... 235/380
4,922,522 A 5/1990 Scanlon ..... 379/95
4,926,255 A 5/1990 Von Kohorn ..... 358/84
4,926,327 A 5/1990 Sidley ..... 364/412
4,965,825 A 10/1990 Harvey et al. ..... 380/233
4,969,183 A 11/1990 Reese ..... 379/88
4,996,705 A 2/1991 Entenmann et al. ..... 379/91
5,007,649 A 4/1991 Richardson ..... 273/237
5,034,807 A 7/1991 Von Kohorn ..... 358/84
5,054,787 A 10/1991 Richardson ..... 273/369
5,057,915 A 10/1991 Von Kohorn ..... 358/84
5,083,271 A 1/1992 Thacher et al. ..... 364/411
5,083,272 A 1/1992 Walker et al. ..... 364/412
5,083,800 A 1/1992 Lockton ..... 273/439
5,096,195 A 3/1992 Gimmon ..... 273/138
5,096,202 A 3/1992 Hesland ..... 273/237
5,112,050 A 5/1992 Koza et al. ..... 273/139
5,119,295 A 6/1992 Kapur ..... 364/412
5,167,508 A 12/1992 Mc Taggart ..... 434/317
5,178,389 A 1/1993 Bentley et al. ..... 273/138 A
5,186,471 A 2/1993 Vancraeynest ..... 273/439
5,218,631 A 6/1993 Katz ..... 463/41
5,227,874 A 7/1993 Von Kohorn ..... 358/84
5,233,654 A 8/1993 Harvey et al. ..... 380/20
5,249,044 A 9/1993 Von Kohorn ..... 358/86
5,276,312 A 1/1994 McCarthy ..... 235/380
5,280,426 A 1/1994 Edmonds ..... 364/408
5,282,620 A 2/1994 Keesee ..... 273/138
5,283,734 A 2/1994 Von Kohorn ..... 364/412
5,286,023 A 2/1994 Wood ..... 273/138
5,297,802 A 3/1994 Pocock et al. ..... 273/439
5,326,104 A 7/1994 Pease et al. ..... 273/138 A
5,327,485 A 7/1994 Leaden ..... 379/95
5,333,868 A 8/1994 Goldfarb ..... 273/138 A
5,340,119 A 8/1994 Goldfarb ..... 273/439
5,351,970 A 10/1994 Fioretti ..... 273/439
5,354,069 A 10/1994 Guttman et al. ..... 273/439
5,365,575 A 11/1994 Katz ..... 379/92
5,398,932 A 3/1995 Eberhardt et al. ..... 273/138 A
5,403,999 A 4/1995 Entenmann et al. ..... 235/379
5,408,417 A 4/1995 Wilder ..... 364/479
5,411,258 A * 5/1995 Wilson et al. ..... 273/86 B
5,415,416 A 5/1995 Scagnelli et al. ..... 273/439
5,417,424 A 5/1995 Snowden et al. ..... 273/138
5,505,449 A 4/1996 Eberhardt et al. ..... 273/138
5,507,489 A 4/1996 Reibel et al. ..... 273/138
5,518,253 A 5/1996 Pocock et al. ..... 273/439
5,539,450 A 7/1996 Handelman ..... 348/12
5,539,822 A 7/1996 Lett ..... 380/20
5,545,088 A 8/1996 Kravitz et al. ..... 463/40
5,564,977 A 10/1996 Algie ..... 463/25
5,569,083 A 10/1996 Fioretti ..... 463/19
5,573,244 A 11/1996 Mindes ..... 463/26
5,575,474 A 11/1996 Rossides ..... 463/26
5,577,727 A 11/1996 Brame et al. ..... 273/139
5,586,937 A 12/1996 Menashe ..... 463/41
5,608,785 A 3/1997 Kasday ..... 379/90
5,617,565 A * 4/1997 Augenbraun et al. ..... 395/604
5,634,064 A * 5/1997 Warnock et al. ..... 395/774
5,643,088 A 7/1997 Vaughn et al. ..... 463/40
5,647,795 A 7/1997 Stanton ..... 463/1
5,679,077 A 10/1997 Pocock et al. ..... 463/19
5,683,090 A 11/1997 Zeile et al. ..... 273/269
5,688,174 A 11/1997 Kennedy ..... 463/37
5,713,795 A 2/1998 Kohorn ..... 463/17
5,722,890 A 3/1998 Libby et al. ..... 463/17
5,729,212 A 3/1998 Martin ..... 340/870.28
5,746,657 A 5/1998 Ueno ..... 463/41
5,749,785 A 5/1998 Rossides ..... 463/25
5,755,621 A 5/1998 Marks et al. ..... 463/42
5,759,101 A 6/1998 Von Kohorn ..... 463/40
5,762,552 A 6/1998 Vuong et al. ..... 463/25
5,772,511 A 6/1998 Smeltzer ..... 463/17
5,787,156 A 7/1998 Katz ..... 379/93.13
5,800,268 A 9/1998 Molnick ..... 463/40
5,816,917 A 10/1998 Kelmer et al. ..... 463/16
5,816,919 A 10/1998 Scagnelli et al. ..... 463/25
5,823,879 A 10/1998 Goldberg et al. ..... 463/42
5,830,067 A 11/1998 Graves et al. ..... 463/40
5,830,068 A 11/1998 Brenner et al. ..... 463/42
5,830,069 A 11/1998 Soltesz et al. ..... 463/42
5,871,398 A 2/1999 Schneier et al. ..... 463/16
5,893,109 A 4/1999 DeRose et al. ..... 707/104
5,893,132 A 4/1999 Huffman et al. ..... 707/532
5,910,047 A 6/1999 Scagnelli et al. ..... 463/17
5,954,582 A 9/1999 Zach ..... 463/25
5,956,034 A 9/1999 Sachs et al. ..... 345/350
5,986,690 A 11/1999 Hendricks ..... 348/7
5,999,808 A 12/1999 LaDue ..... 455/412
6,001,016 A 12/1999 Walker et al. ..... 463/42
6,004,211 A 12/1999 Brenner et al. ..... 463/40
6,007,426 A 12/1999 Kelly et al. ..... 463/16
6,021,433 A * 2/2000 Payne et al. ..... 709/219
6,024,640 A 2/2000 Walker et al. ..... 463/17
6,024,641 A 2/2000 Sarno ..... 463/17
6,030,288 A 2/2000 Davis et al. ..... 463/29
6,080,062 A 6/2000 Olson ..... 463/42
6,080,063 A 6/2000 Khosla ..... 463/42
6,099,408 A 8/2000 Schneier et al. ..... 463/29
6,102,797 A 8/2000 Kail ..... 463/16
6,117,011 A 9/2000 Lvov ..... 463/25
6,117,013 A 9/2000 Eiba ..... 463/41
6,124,851 A 9/2000 Jacobson ..... 345/206
6,152,824 A 11/2000 Rothschild et al. ..... 463/42
6,163,795 A * 12/2000 Kikinis ..... 709/203
6,186,892 B1 2/2001 Frank et al. ..... 463/19
6,203,427 B1 3/2001 Walker et al. ..... 463/16
6,251,016 B1 6/2001 Tsuda et al. ..... 463/42
6,251,017 B1 6/2001 Leason et al. ..... 463/42
6,254,480 B1 7/2001 Zach ..... 463/17
6,256,071 B1 * 7/2001 Hiroi ..... 348/553
6,257,982 B1 7/2001 Rider et al. ..... 463/31
6,263,054 B1 7/2001 Haefliger ..... 379/93.13
6,264,560 B1 7/2001 Goldberg et al. ..... 463/42
6,272,223 B1 8/2001 Carlson ..... 380/251
6,273,820 B1 8/2001 Haste, III ..... 463/40
2001/0003099 A1 6/2001 Von Kohorn ..... 463/40
2001/0003100 A1 6/2001 Yacenda ..... 463/41

FOREIGN PATENT DOCUMENTS

EP 0 673 004 A3 9/1995 ..... G07F/17/32
EP 0 673 004 A2 9/1995 ..... G07F/17/32
EP 0 873 772 A1 10/1998 ..... A63F/9/22
EP 0 934 765 A1 8/1999 ..... A63F/9/22

| | | | | |
|---|---|---|---|---|
| GB | 2 300 535 | A | 11/1996 | ..... H04N/5/262 |
| JP | 01-269157 | | 10/1989 | ..... G06F/15/28 |
| JP | 02-110660 | | 4/1990 | ..... G06F/15/28 |
| JP | 02-231671 | | 9/1990 | ..... G06F/15/28 |
| JP | 06-325062 | | 11/1994 | ..... G06F/15/28 |
| WO | 0 624 039 | A2 | 11/1994 | ..... H04N/7/173 |
| WO | WO 95/01058 | | 1/1995 | ..... H04N/7/16 |
| WO | WO 95/15649 | | 6/1995 | ..... H04N/7/087 |
| WO | WO 95/30944 | | 11/1995 | |
| WO | WO 97/19428 | | 5/1997 | ..... G07F/17/32 |
| WO | WO 99/45491 | | 9/1999 | ..... G06F/19/00 |
| WO | WO 99/49383 | | 9/1999 | ..... G06F/3/00 |
| WO | WO 99/61973 | | 12/1999 | ..... G06F/1/16 |
| WO | WO 00/21239 | | 4/2000 | ..... H04L/9/00 |
| WO | WO 00/23884 | | 4/2000 | ..... G06F/9/44 |
| WO | WO 00/23885 | | 4/2000 | ..... G06F/9/44 |
| WO | WO 00/23902 | | 4/2000 | ..... G06F/13/40 |
| WO | WO 00/23904 | | 4/2000 | ..... G06F/15/02 |
| WO | WO 00/23911 | | 4/2000 | ..... G06F/17/21 |
| WO | WO 00/23914 | | 4/2000 | ..... G06F/17/22 |
| WO | WO 00/23916 | | 4/2000 | ..... G06F/17/30 |
| WO | WO 00/23926 | | 4/2000 | ..... G06F/17/60 |
| WO | WO 00/24175 | | 4/2000 | ..... H04L/29/06 |
| WO | WO 00/45299 | | 8/2000 | ..... G06F/17/30 |
| WO | WO 00/45588 | | 8/2000 | ..... H04N/1/00 |
| WO | WO 01/03088 | | 1/2001 | ..... G07F/17/32 |

OTHER PUBLICATIONS

Ross Peddicord, "New On TV: You Bet Your Horse," The Sun, Baltimore, Maryland, Dec. 15, 1994.

Yee–Hsiang Chang et al., "An Open–Systems Approach To Video On Demand," IEEE Communications Magazine, May 1994, pp. 68–80.

TrackMaster User's Guide Version 2.0.7, Apr., 1994, AXCIS Pocket Information Network, Inc., Santa Clara, California, pp. 1–122.

Tiny Tim Brochure, AutoTote Systems, Inc., Newark, Delaware (undated).

Probe XL Brochure, AutoTote Systems, Inc., Newark, Delaware (undated).

* cited by examiner

80

1 TURFWAY PARK ← 82 Ⓕ CLM 7500(7.5-6.5)

5 1/2 *FURLONGS*( 1:03$^{2}$ )CLAIMING. PURSE $9,000 FOR FILLIES THREE YEARS OLD. WEIGHT 122 IBS. NON-WINNERS OF THREE RACES ALLOWED, 3 LBS. TWO RACES, 6LBS. A RACE, 9LBS. CLAIMING PRICE $7,500, FOR EACH $500 TO $6,500 1 LB. (RACES FOR $6,250 OR LESS NOT CONSIDERED IN ALLOWANCES).

84 88

START — 5 1/2 FURLONGS — FINISH 90

86 LAURA B

OWN: LEAR MARVIN

THOMPSON T J (282 36 35 28 .13) 2000:(206 32 .16)

94 $7,500

DK.B OR BR F. 3 (APR)
SIRE: YELLOW CREEK (IRISH TOWER) 96
DAM : MARCIE'S PURSUIT (PURSUIT)
BR: WILLIAM MARVIN LEAR SR (KY)
TR: CAIN JOE(44 9 8 5 .20) 2000:(37 8 .22)

92

| | | | | | | | | | | | | | | | | | | | |
|---|---|---|---|---|---|---|---|---|---|---|---|---|---|---|---|---|---|---|---|
| 8MAR00-5TP | FST | 6F | | :22$^{4}$ | :47 | 1:00$^{1}$ | 1:14 | Ⓕ | CLM 7500 | **21** | 1 | 7 | 7$^{5}$ | 7$^{10}$ | 7$^{10}$ | 6$^{13\ 1/4}$ | THOMOPSON T J | L | 116 |
| 9FEB00-2TP | FST | 6$^{1/2}$F | | :23 | :47$^{1}$ | 1:13$^{4}$ | 1:21 | Ⓕ | CLM 7500 | **43** | 2 | 7 | 5$^{2\ 1/2}$ | 4$^{1\ 1/2}$ | 3$^{1\ 1/2}$ | 3$^{3\ 1/2}$ | THOMOPSON T J | L | 116 |
| 26JAN00-7TP | FST | 6F | | :22$^{2}$ | :46$^{4}$ | 1:00 | 1:14$^{2}$ | Ⓕ | CLM 12000(15-10) | **31** | 7 | 2 | 5$^{7}$ | 5$^{11}$ | 6$^{7\ 1/2}$ | 6$^{6\ 1/4}$ | ARGUELLO F A JR | L | 113 |
| 26NOV99-1Hoo | SLY | 6F | | :22$^{3}$ | :46$^{2}$ | :59$^{3}$ | 1:13$^{2}$ | Ⓕ | MD 10000 | **45** | 5 | 3 | 5$^{6\ 1/2}$ | 3$^{5}$ | 2$^{4}$ | 1$^{1\ 3/4}$ | JOHNSON P A | LB | 119 |
| 12NOV99-5Hoo | FST | 6F | | :22$^{4}$ | :46$^{2}$ | :59$^{2}$ | 1:12$^{1}$ | Ⓕ | MD 15000 | **42** | 3 | 1 | 1$^{hd}$ | 1$^{2}$ | 3$^{nk}$ | 4$^{5\ 1/2}$ | MOSS R W | LB | 119 |
| 22OCT99-3Hoo | FST | 6F | | :23$^{1}$ | :47$^{1}$ | 1:00$^{2}$ | 1:13$^{2}$ | Ⓕ | MD SP WT 19K | **26** | 7 | 2 | 6$^{2\ 1/4}$ | 5$^{6\ 1/2}$ | 5$^{12}$ | 5$^{13\ 1/2}$ | MOSS R W | LB | 119 |
| 104 21SEP99-3KD | YL | 6F | Ⓣ | :24 | :50$^{4}$ | | 1:17$^{3}$ | Ⓕ | MD 17500 (17.5-15) | **18** | 1 | 1 | 1$^{hd}$ | 1$^{hd}$ | 3$^{3\ 1/2}$ | 7$^{12}$ | MOSS R W | L | 121 |
| 22AUG99-1EIP | FST | 5$^{1/2}$F | | :23$^{1}$ | :47$^{3}$ | 1:01$^{1}$ | 1:08$^{1}$ | Ⓕ | MD 17500 (17.5-15) | **24** | 3 | 1 | 2$^{2\ 1/2}$ | 3$^{4}$ | 3$^{8\ 1/2}$ | 4$^{8}$ | MOSS R W | L | 120 |
| 9AUG99-3EIP | FST | 6F | | :23$^{1}$ | :48$^{4}$ | 1:02$^{3}$ | 1:16$^{4}$ | Ⓕ | MD 17500 (17.5-15) | **23** | 6 | 5 | 6$^{4}$ | 5$^{4}$ | 2$^{3}$ | 2$^{1\ 1/2}$ | STEWART J F JR | L | 120 |
| 11JLY99-1EIP | FST | 5$^{1/2}$F | | :23 | :47$^{1}$ | | 1:07$^{1}$ | Ⓕ | MD 30000 (30-25) | **-0** | 2 | 7 | 8$^{11}$ | 7$^{13}$ | 7$^{23}$ | 6$^{25}$ | CAMPBELL J M | | 120 |

102 98 100 L 116

| | | | | | | | | | | | | | |
|---|---|---|---|---|---|---|---|---|---|---|---|---|---|
| LIFE | 10 | 1 | 1 | 1 | $11,883 | D.FST | 8 | 0 | 1 | 1 | $4,599 | | 43 |
| 2000 | 3 | 0 | 0 | 1 | $1,009 | WET | 1 | 1 | 0 | 0 | $7,200 | | 45 |
| 1999 | 7 | 1 | 1 | 0 | $10,874 | TURF | 1 | 0 | 0 | 0 | $84 | | 18 |
| TP | 3 | 0 | 0 | 1 | $1,009 | DIST | 2 | 0 | 0 | 0 | $660 | | 24 |

| | | | | | |
|---|---|---|---|---|---|
| 2.40 | 58-20 | **WALNUTSPRINGS**116$^{1\ 1/2}$ **FVORITEAGIN**116$^{hd}$ **TOSTTOHENIU**116$^{1\ 1/2}$ | UNHURRIED EARLY | 7 |
| 5.80 | 66-19 | MISS DUSTY116$^{1\ 1/2}$ REBS TEMPTRESS111$^{2}$ LAURA B116$^{1\ 1/2}$ | STEADIED 5/16 POLE | 9 |
| 1.80e | 63-24 | PRUNERDEW116$^{1\ 1/2}$ RAINBOW MISS119$^{1}$ *MISS DUSTY*115$^{3/4}$ | 3 WIDE, NO FACTOR | 9 |
| 3.10 | 70-25 | LAURA B119$^{1\ 3/4}$ **SUPER TRUE**119$^{2\ 1/4}$ GRANDMA RUBY119$^{1/2}$ | DRIVING | 9 |
| 6.40 | 70-22 | GUITAR114$^{5}$ MABLEARLENE119$^{nk}$ JUST GOLD119$^{nk}$ | GAVE WAY | 10 |
| 49.50 | 56-34 | *SUE'S THEBOSS*119$^{6\ 1/4}$ MYINDISCRTION119$^{3/4}$ KRISTI'SPLSUR119$^{6\ 1/4}$ | EVENLY, NO RALLY | 10 |
| 19.60 | 49-28 | LADY DENIRO116$^{3\ 1/2}$ TOOSOME BLUFF121$^{hd}$ WRONG NUMBER121$^{1\ 1/2}$ | DUELED, TIRED | 10 |
| *1.50 | 70-18 | SOME LUCK110$^{2\ 3/4}$ CADA120$^{4}$ SERVING MA MAN120$^{1\ 1/4}$ | FLATTENED OUT, STRETCH | 7 |
| 28.10 | 62-24 | SILKY FLIGHT120$^{1\ 1/2}$ LAURA B120$^{1}$ *RAINBOW MISS*120$^{2}$ | 5WIDE BID, 2ND BEST | 7 |
| 29.50 | 58-23 | HEAVENLY SUNSHINE120$^{8}$ *DANZIG MATILDA*120$^{3}$ SHELLOUT120$^{2}$ | OUTRUN | 8 |

FIG. 6A

86

SUPER TRUE
OWN: RICHARD & MARGARET ROMPIES
D'AMICO A J (461 98 88 57 .21) 2000:(327 76 .23) $7,500

B. F. 3 (MAY) KEESEP98 $15,000
SIRE: SUPREMO (GONE WEST) $5,000
DAM: BIG n' TRUE (TRUE COLORS)
BR: ANTHONY E GUIDA (KY)
TR: JONES JEFFREY S (18 3 0 3 .17) 2000:(46 8 .17)

| | | | | | | | | | | | | | | | | | |
|---|---|---|---|---|---|---|---|---|---|---|---|---|---|---|---|---|---|
| 17 MAR-6Beu | FST | 5F | :22$^{3}$ | :47$^{1}$ | | 1:02$^{1}$ | Ⓕ CLM 5000N2L | **27** | 1 | 1 | 1$^{hd}$ | 1$^{1\ 1/2}$ | 1$^{2\ 1/2}$ | 1$^{3}$ | | GUERRA J A | L 111 FB |
| PREVIOUSLY TRAINED BY PAULUS DAVID E | | | | | | | | | | | | | | | | | |
| 8MAR00-5TP | FST | 6F | :22$^{4}$ | :47 | 1:00$^{1}$ | 1:14 | Ⓕ CLM 7500 | **19** | 5 | 1 | 1$^{hd}$ | 2$^{hd}$ | 6$^{7\ 3/4}$ | 7$^{14\ 1/4}$ | | VITEK J J | L 116 FB |
| 7FEB00-1Beu | GD | 5F | :23 | :46$^{2}$ | | :58$^{3}$ | Ⓕ MD 7500(7.5-6.5) | **53** | 4 | 1 | 1$^{1/2}$ | 1$^{1\ 1/2}$ | 1$^{3}$ | 1$^{1}$ | | PRESCOTT R | L 118 FB |
| 22JAN00-1TP | FST | 5$^{1/2}$F | :22$^{4}$ | :46$^{3}$ | :59$^{2}$ | 1:05$^{4}$ | Ⓕ MD 7500 | **14** | 5 | 1 | 1$^{2}$ | 1$^{hd}$ | 2$^{3}$ | 6$^{13\ 3/4}$ | | ZIMMERMAN R | L 122 B |
| 19DEC99-1TP | FST | 6F | :22$^{1}$ | :46$^{1}$ | :58$^{4}$ | 1:12$^{2}$ | Ⓕ MD 7500 | **12** | 2 | 3 | 2$^{1}$ | 3$^{4}$ | 5$^{10}$ | 7$^{13\ 1/2}$ | | ZUNIGA J E | L 122 FBN |
| 11DEC99-1TP | FST | 5$^{1/2}$F | :22$^{3}$ | :46$^{4}$ | :59$^{3}$ | 1:06$^{2}$ | Ⓕ MD 7500 | **33** | 9 | 1 | 1$^{4}$ | 1$^{3\ 1/2}$ | 2$^{1}$ | 3$^{5}$ | | HERRELL J C | L 122 FB |
| 26NOV99-1Hoo | SLY | 6F | :22$^{3}$ | :46$^{2}$ | :59$^{3}$ | 1:13$^{2}$ | Ⓕ MD 10000 | **41** | 6 | 1 | 1$^{2\ 1/2}$ | 1$^{2}$ | 1$^{4}$ | 2$^{1\ 3/4}$ | | LEJEUNE S P JR | LB 119 FB |
| 25OCT99-5Hoo | FST | 5$^{1/2}$F | :22$^{1}$ | :46$^{4}$ | :59$^{3}$ | 1:07 | Ⓕ MD 15000 | **18** | 4 | 1 | 3$^{1\ 1/2}$ | 3$^{3}$ | 8$^{8\ 1/4}$ | 9$^{12\ 1/4}$ | | SMITH V L | LB 119 B |
| 8OCT99-3Hoo | SLY | 5$^{1/2}$F | :22$^{2}$ | :46$^{3}$ | :59$^{2}$ | 1:06$^{1}$ | Ⓕ MD 25000(30-25) | **35** | 4 | 2 | 2$^{2}$ | 3$^{2}$ | 4$^{4\ 1/2}$ | 7$^{4\ 3/4}$ | | SMITH V L | LB 117 B |
| 22SEP99-2TP | FST | 6F | :22$^{4}$ | :47$^{4}$ | 1:01$^{4}$ | 1:15$^{2}$ | Ⓕ MD 15000(15-10) | **29** | 7 | 1 | 1$^{2\ 1/2}$ | 1$^{1}$ | 1 1/2 | 3$^{6}$ | | ARGUELLO F A JR | L 121 B |

L 116

| | | | | | | | | | | | | | | |
|---|---|---|---|---|---|---|---|---|---|---|---|---|---|---|
| LIFE | 13 | 2 | 1 | 2 | $11,503 | D.FST | 9 | 1 | 0 | 2 | $5,609 | 33 |
| 2000 | 4 | 2 | 0 | 0 | $6,495 | WET | 4 | 1 | 1 | 0 | $5,894 | 53 |
| 1999 | 9 | M | 1 | 2 | $5,008 | TURF | 0 | 0 | 0 | 0 | $0 | - |
| TP | 5 | 0 | 0 | 2 | $2,065 | DIST | 8 | 2 | 0 | 1 | $7,729 | 53 |

| | | | | | |
|---|---|---|---|---|---|
| *1.00 | 74-18 | SUPER TRUE111$^{3}$ | PROPER GRACE116$^{1/2}$ | ACEY DECY116$^{1\ 1/2}$ | DREW OFF, DRIVING 9 |
| 10.70 | 57-20 | **WALNUTSPRINGS**116$^{1\ 1/2}$ | **FVORITEAGIN**116$^{hd}$ | **TOSTTOHENIU**116$^{1\ 1/2}$ | OFF INSIDE, FADED 7 |
| 3.20 | 92-09 | SUPER TRUE118$^{1}$ | *HALLELUJAH NELLIE*118$^{4\ 1/2}$ | COOL AFFAIR114$^{1}$ | DRIVING 6 |
| 3.10 | 78-12 | *LOOK AT ME*122$^{8}$ | TELL YOU WHAT122$^{nk}$ | DALLAS CHEERLEADER117$^{4}$ | INSIDE, TIRED 9 |
| 1.90 | 63-16 | KTHERINEANN122$^{4}$ | *MISSDUSTY*122$^{3\ 1/2}$ | TEXSMILLENNIUM122$^{4\ 1/2}$ | THROUGH AFTER 1/2 9 |
| *.90 | 88-12 | *LIL BITOFCOUNTRY*117$^{4\ 1/2}$ | ANOTHERTRY122 1/2 | SUPERTRUE122$^{2\ 1/2}$ | PACE, INSIDE, TIRED 9 |
| 8.50 | 68-25 | **LAURA B**119$^{1\ 3/4}$ | SUPER TRUE119$^{2\ 1/4}$ | GRANDMA RUBY119$^{1/2}$ | WEAKENED LATE STRETCH 9 |
| 7.10 | 64-26 | VANDANIERE199$^{nk}$ | *MARFARITA*119$^{1\ 3/4}$ | *PRUNERDEW*119$^{1/2}$ | STUMBLED START 10 |
| 17.60 | 75-22 | GONECOASTAL117$^{2\ 3/4}$ | *VNDNIERE*119$^{nk}$ | RELLYNTURL119$^{3/4}$ | PROMPTED PACE, STOPPED 9 |
| 76.50 | 58-28 | AUTHENTIC CALLER121$^{3}$ | SNOWYLAKE121$^{3}$ | SUPER TRUE121$^{3}$ | OFF INSIDE, TIRED 9 |

AT A GLANCE

1 TURFWAY PARK

BEST BEYER AT THE TRACK — WALNUT SPRINGS (104, 105)

BEST BEYER AT THE DISTANCE — SUPER TRUE (106, 107)

TRACK/DISTANCE WINNERS — KITTY'S GOLD, SAY WHEN TO ROCK (108, 109)

FIRST RACE OFF LAYOFF — NONE (110, 111)

FIG. 6B

ELECTRONIC BOOK INTERACTIVE WAGERING SYSTEM

This application claims the benefit of U.S. provisional application No. 60/186,267, filed Mar. 1, 2000, which is hereby incorporated by reference herein in its entirety.

BACKGROUND OF THE INVENTION

This invention relates to interactive wagering, and more particularly, to interactive wagering arrangements that use electronic books.

Wagering is a popular leisure activity. For example, many racing fans wager on events such as horse, dog, and harness racing. However, it may be inconvenient to attend racing events in person. Not all racing fans have sufficient time to visit racetracks as often as they would like and some fans have difficulties in obtaining suitable transportation to the track. Off-track betting establishments are available for fans who cannot attend racing events in person, but fans must still travel to the off-track betting establishments.

As a result, systems have been developed in which fans may place off-track wagers using personal computers connected to the Internet, standard telephones, or set-top boxes.

It is an object of the present invention to improve such systems by providing an interactive wagering system that allows users to access racing information or to place wagers using an electronic book or other suitable platform.

SUMMARY OF THE INVENTION

An interactive wagering system is provided in which users may download electronic racing forms to electronic books. The electronic books may have covers made of leather or other protective materials. Each electronic book may have a display that is approximately the size of a letter-sized pad of paper. The display may be a back-lit monochrome or color display. The electronic book may have buttons such as page up and page down buttons or the like that allow users to navigate through the material presented on the electronic book.

The content of the racing form may be directed toward horse racing. The form may be an electronic replica of a printed form. If desired, the racing form may be interactive. When a user selects an item from a racing form displayed on the electronic book, the user may be presented with additional information or interactive screens that provide racing-related services such as interactive wagering opportunities. For example, when the user selects a jockey name, the user may be provided with more information about that jockey. When the user selects a racetrack name, the user may be provided with an opportunity to create an electronic wager for a race at the selected racetrack.

The interactive wagering system may have a transaction processing and subscription management system for handling wagers. Racing forms may be downloaded from the transaction processing and subscription management system or may be downloaded from electronic book servers or the like.

There may occasionally be a change in the information that is presented in the racing form. For example, a horse may scratch or there may be other changes. These changes may be provided to the user of the electronic book. In particular, updates to the racing data that is provided to the electronic book (e.g., for use with the racing form) may be provided. Updates may be provided on request by the user, at predetermined time intervals, at user-selected time intervals, etc.

News flashes and other real-time information and reports may be provided to the electronic book. Such reports may be based on the user's preferences and the user's monitored interests. For example, if the user has previously expressed a desire to receive news on a particular horse, the interactive wagering system may provide a real-time report to the user when that horse is in the news. If the user often wagers at a particular racetrack, the system may monitor this information to determine the user's interest in the track. Real-time reports or news may then be targeted to the user based on the user's monitored interests.

The racing form may include racing data, articles, and advertisements.

Further features of the invention, its nature and various advantages will be more apparent from the accompanying drawings and the following detailed description of the preferred embodiments.

BRIEF DESCRIPTION OF THE DRAWINGS

FIG. 6 shows an illustrative racing form that may be displayed using an electronic book in accordance with the present invention.

DETAILED DESCRIPTION OF THE PREFERRED EMBODIMENTS

Figure 1:
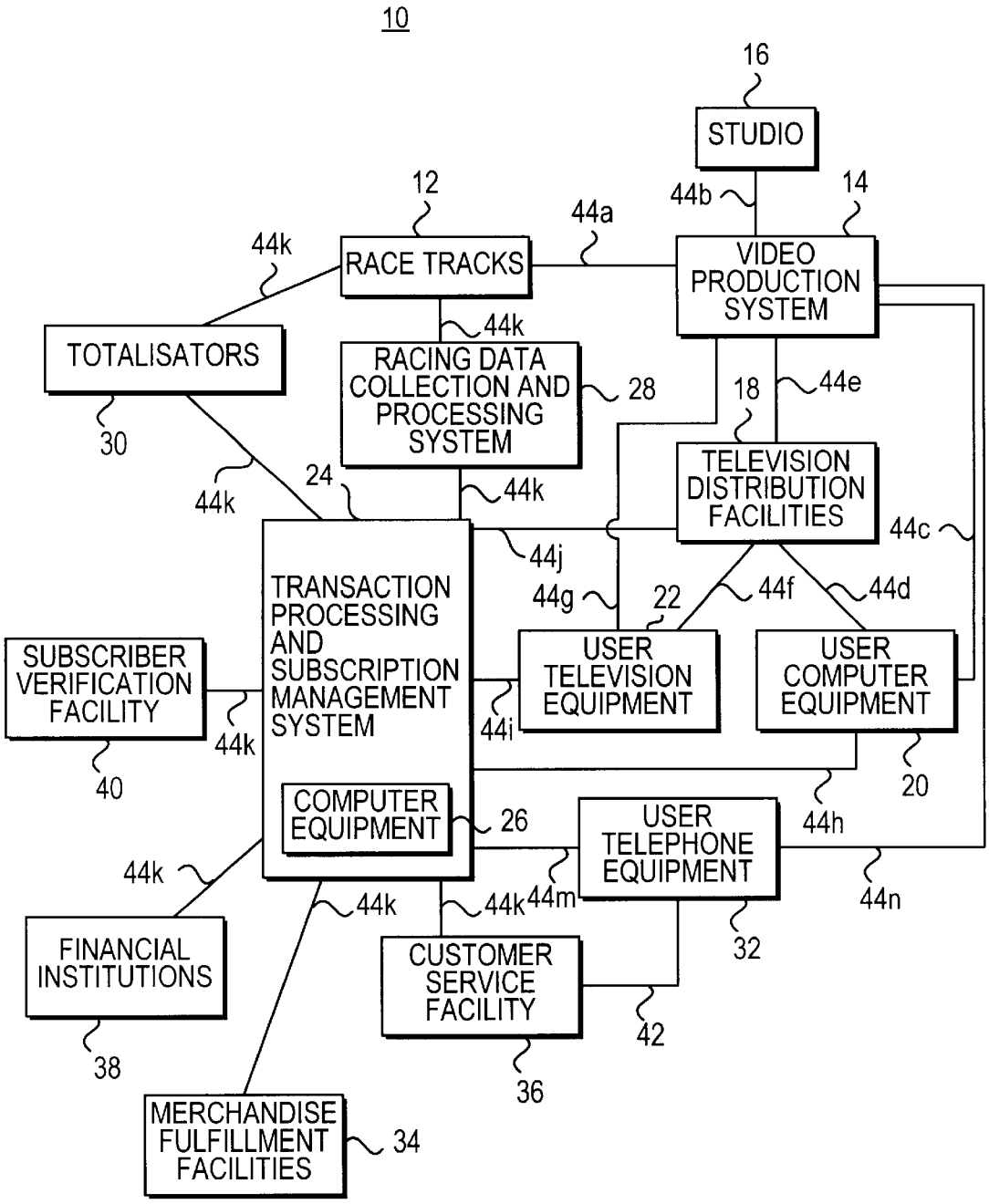
FIG. 1 is a schematic diagram of an illustrative interactive wagering system on which an interactive wagering application may be implemented in accordance with the present invention.

An illustrative interactive wagering system 10 in accordance with the present invention is shown in FIG. 1. Aspects of the invention apply to various different types of wagering, but are described herein primarily in the context of interactive wagering on races (e.g., horse races) for specificity and clarity.

Races may be run at racetracks 12, which may be located at various geographic locations. Races run at the racetracks may be simulcast to television viewers. For example, simulcast videos may be provided to users with satellite receivers or to off-track betting establishments via satellite.

System 10 may be used to provide an interactive wagering service to users of various user equipment. An interactive wagering application may be used to provide the wagering service. The interactive wagering application may run locally on the user equipment (e.g., on a set-top box, personal computer, electronic book, cellular telephone, handheld computing device, etc.) or may run using a client-server or distributed architecture where some of the application is implemented locally on the user equipment in the form of a client process and some of the application is implemented at a remote location (e.g., on a server computer or other such equipment in the system) as a server process. These arrangements are merely illustrative. Other suitable techniques for implementing the interactive wagering application may be used if desired.

Real-time videos from racetracks 12 may also be provided to video production system 14 for distribution to users as part of a television wagering service (i.e., a wagering-related television channel or Internet-delivered service or the like). If desired, multiple simulcast videos may be provided to video production system 14 in real-time. Talent (e.g., commentators) for the television wagering service provided by the interactive wagering application may be located at studio 16. Studio 16 may provide a video feed containing commentary and the like to video production system 14. Graphic overlays for the television wagering service may be added to the service at video production system 14.

The television wagering service may use video production system 14 to combine selected video segments from desired racing simulcasts with the video feed from studio 16 and suitable graphic overlays. If desired, video production system 14 or a separate facility may be used to reformat simulcasts from racetracks 12. For example, if racetracks 12 provide simulcasts as traditional analog television channels, video production system 14 (or a separate facility) may convert these simulcasts or portions of these simulcasts into digital signals (e.g., digital video signals) or into a different number of analog signals. Digital video signals may require less bandwidth than analog video signals and may be appropriate for situations in which videos are to be transmitted over either high or low bandwidth pathways. Low bandwidth pathways may include telephone lines, the Internet, etc.

Video production system 14 may be used to provide a television wagering service that includes selected simulcast videos, video from studio 16, and graphic overlays to television distribution facilities 18 (for redistribution to user television equipment 22 and user computer equipment 20), to user computer equipment 20, and to user telephone equipment 32 (if user telephone equipment 32 has a display capable of displaying moving images). Television distribution facilities 18 may be any suitable facilities for supplying television to users, such as cable system headends, satellite systems, broadcast television systems, or other suitable systems or combinations of such systems. User computer equipment 20 may be any suitable computer equipment that supports an interactive wagering application. For example, user computer equipment 20 may be a personal computer. User computer equipment 20 may also be based on a mainframe computer, a workstation, a networked computer or computers, a laptop computer, a notebook computer, a handheld computing device such as a personal digital assistant or other small portable computer, etc. One aspect of the invention involves the use of an electronic book platform as user computer equipment 20 or part of user computer equipment 20.

Each of television distribution facilities 18 is typically located at a different geographic location. Users with user television equipment 22 may receive the television wagering service from an associated television distribution facility. User television equipment 22 may include, for example, a television or other suitable monitor. A television may be used to watch the television wagering service on a traditional analog television channel. User television equipment 22 may also include a digital or analog set-top box connected to a television distribution facility 18 by a cable path. A digital set-top box may be used to receive the television wagering service on a digital channel. If desired, user television equipment 22 may contain a satellite receiver, a WebTV box, a personal computer television (PC/TV), or hardware similar to such devices into which set-top box capabilities have been integrated. A recording device such as a videocassette recorder or digital recording device (e.g., a personal video recorder or digital video recorder based on hard disk drives or the like) may be used in user television equipment 22 to store videos. The recording device may be separate from or part of the other components of user television equipment 22.

User computer equipment 20 may receive the television wagering service using a video card or other video-capable equipment to receive analog or digital (e.g., moving picture experts group or MPEG) videos from a television distribution facility. User computer equipment 20 may also receive the television wagering service directly from video production system 14 using, for example, a modem link. If desired, the video for the television wagering service may be compressed (e.g., using MPEG techniques). This may be useful, for example, if the path to user computer equipment 20 is a modem connection using telephone links. If video production system 14 is only used to serve user computer equipment 20 without traditional analog television capabilities, video production system 14 may only need to supply such digitally-compressed video signals and not analog television signals.

Video clips of races and other simulcast information may be provided to users in the form of a television wagering service or by an interactive wagering service provided by the interactive wagering application. If desired, race-related videos may be provided to the user by using video production system 14 or other suitable equipment to route appropriate video clips from the simulcasts to the user in real time. Video clips may also be stored for later viewing. For example, one or more video servers located at racetracks 12, video production system 14, television distribution facilities 18, or other suitable locations may be used to store video clips. The stored videos may then be played back in real time or downloaded for viewing at user television equipment 22, user computer equipment 20, or user telephone equipment 32. The video clips may contain videos of races, commentary, interviews with jockeys, or any other suitable race-related information. If desired, real-time or stored videos may be provided from racetracks 12 directly to user television equipment 22, user computer equipment 20, or user telephone equipment 32 over the Internet or other suitable communications paths without involving video production system 14. Videos may also be provided by routing video signals through equipment located elsewhere in system 10. For example, videos may be routed through transaction processing and subscription management system 24.

Transaction processing and subscription management system 24 may contain computer equipment 26 and other equipment for supporting system functions such as transaction processing (e.g., handling tasks related to wagers, product purchasing, adjusting the amount of funds in user accounts based on the outcomes of wagers, video clip ordering, etc.), data distribution (e.g., for distributing racing data to the users), and subscriber management (e.g., features related to opening an account for a user, closing an account, allowing a user to add or withdraw funds from an account, changing the user's address or personal identification number, etc.). Databases within transaction processing and subscription management system 24 or associated with system 24 may be used to store racing data, wagering data and other transaction data, and subscriber data such as such as information on the user's current account balance, past wagering history, individual wager limits, personal identification number, billing addresses, credit card numbers, bank account numbers, social security numbers, etc. Using such databases may allow the user to access information more quickly and allows for central administration of the wagering service.

If desired, racing videos and other services may be provided using servers and other equipment located at transaction processing and subscription management system 24. For example, video clips may be provided to the user on-demand. Interactive advertisements may be provided to the user. When the user selects a desired advertisement, transaction processing and subscription management system 24 may provide additional information or other services related to the advertisement to the user.

Product ordering services may be implemented using computer equipment at transaction processing and subscriber management system 24 to handle orders and to assist in adjusting the appropriate account of the user accordingly. Orders may be fulfilled using merchandise fulfillment facilities 34. Merchandise fulfillment facilities 34 may be operated solely to provide merchandise fulfillment or may be associated with independently-operated mail-order or on-line businesses. Similar facilities may be used to allow users to order services.

Statistical racing data such as the post times for each race, jockey names, runner names and the number of races associated with each track, handicapping information (e.g., information on past performances such as the number of wins and losses for the past year, etc.), and weather conditions at various tracks may be provided by racing data collection and processing system 28. Some of the data may be collected from racetracks 12 and some may be provided by third party information sources such as Axcis Pocket Information Network, Inc. of Santa Clara, Calif. or other suitable data sources.

Racing data may also be provided from totalisators 30. Totalisators 30 are the computer systems that may be used to handle wagers made at the racetracks, made at off-track betting establishments, and made using interactive wagering system 10. Totalisators 30 generate wagering odds in real time. Totalisators 30 generate these odds based on information on which wagers are being placed (e.g., based on information on which wagers are being placed on races at racetracks 12). Totalisators 30 are available from companies such as Amtote International, Inc. of Hunt Valley, Md. Totalisators 30 may be associated with individual racetracks 12 or groups of racetracks 12. Totalisators 30 may communicate with one another using a communication protocol known as the Intertote Track System Protocol (ITSP). This allows totalisators 30 to share wagering pools. Totalisators 30 may provide racing data including information on the current races at racetracks 12, the number of races associated with each racetrack, win, place, and show odds and pool totals for each horse or other runner, and exacta, trifecta, and quinella payoff predictions and pool totals for every possible combination of runners. Totalisators 30 may also provide current odds and other real-time racing data for other types of wagers. Totalisators 30 may provide the time until post time for each race.

Totalisators 30 may provide race results, such as the order-of-finish list for at least the first three positions and payoff values versus a standard wager amount for win, place, and show, for each runner in the finish list. Payoff values may be provided for winning complex wager types such as exacta, trifecta, quinella, pick-n (where n is the number of races involved in the pick-n wager), and daily double. The payoff values may be accompanied by a synopsis of the associated finish list.

Totalisators 30 may also provide program information of the type typically provided in printed racing programs. Such program information may include early odds, early scratches, race descriptions (including the distance of each race and the race surface—grass, dirt, artificial turf, etc.), allowed class ratings (based on a fixed ratio of external criteria), purse value (payoff to winning runner), allowed age range of runners, and the allowed number of wins and starts for each runner.

If desired, some of the information provided to transaction processing and subscription management system 24 by totalisators 30 (such as the program information or other suitable racing data) may be provided by racing data collection and processing system 28. Similarly, some of the information provided to transaction processing and subscription management system 24 by racing data collection and processing system 28 may be provided by totalisators 30. Moreover, the foregoing examples of different suitable types of racing data are merely illustrative. Any suitable data related to racing may be provided to transaction processing and subscription management system 24 if desired.

Transaction processing and subscription management system 24 provides the racing data to users at user television equipment 22, user computer equipment 20, and user telephone equipment 32 for use in following race results and developing wagers. If desired, racing data may be provided to users using paths that do not directly involve transaction processing and subscription management system 24. For example, racing data may be provided from racing data collection and processing system 28 to user television equipment 22, user computer equipment 20, or user telephone equipment 32 using the Internet or other suitable communications paths.

User telephone equipment 32 may be a conventional telephone, a cordless telephone, a cellular telephone or other portable wireless telephone, or any other suitable telephone equipment. Users at user television equipment 22 and user computer equipment 20 may view information on the racing data on a television or other suitable monitor. Users at user telephone equipment 32 may listen to racing data using an interactive voice system. User telephone equipment 32 may be based on cellular telephones with displays. Users may view racing data displayed on such displays.

Users who wish to place wagers may establish an account at transaction processing and subscription management system 24. An account may also be established at one of totalisators 30. The user and the interactive wagering services may have their own bank accounts at financial institutions 38. A user may set up an account electronically by using user television equipment 22, user computer equipment 20, or user telephone equipment 32 to interact with the subscriber management functions of transaction processing and subscription management system 24. If desired, accounts may be established with the interactive wagering service with the assistance of customer service representatives at customer service facility 36. Customer service facility 36 may be at the same location as transaction processing and subscription management system 24, may be part of system 24, or may be located remote from system 24. Customer service representatives at customer service facility 36 may be reached by telephone. If user telephone equipment 32 is used to access the interactive wagering service, for example, user telephone equipment 32 may be used to reach the customer service representative using communications path 42. If user television equipment 22 or user computer equipment 20 is being used with the service, a telephone at the same location as that equipment may be used to reach the customer service representative.

The user's identity may be checked using social security number information or other identification information with the assistance of subscriber verification facility 40. The services of subscriber verification facility 40 are used to ensure that the user lives in a geographic area in which wagering is legal, that the user is of a legal age, and that the identification information (e.g., the user's social security number) matches the name provided by the user. If the user is using a cellular telephone or handheld computing device, the user's present physical location may be determined by determining which general part of the cellular telephone network is being accessed by the user or by using the cellular network or a handset-based location device such as a global positioning system (GPS) receiver in the body of the cellular telephone to pinpoint the user's location. This location information may be used to verify that the user is located in a geographic area where wagering is legal.

In a typical enrollment process, the user provides personal information to the interactive wagering service and provides funds with a credit card or funds from the user's bank account. The interactive wagering service sets up an account for the user at transaction processing and subscription management system 24 and directs one of totalisators 30 to set up a new account for the user at the totalisator. The totalisator is also directed to credit the user's account to reflect the amount of funds provided by the user. After the user places a wager and wins or loses, the totalisator adjusts the user's totalisator account to reflect the outcome of the wager. The totalisator may periodically inform the interactive wagering service of the adjusted balance in the user's account. This may be accomplished using any suitable technique (e.g., periodically, continuously, on-request, etc.). For example, reports may be collected periodically (e.g., once a day in an end-of-day report) and provided to the interactive wagering service to reconcile the account balances at transaction processing and subscription management system 24 with the account balances at totalisators 30.

If the user makes a balance inquiry, the inquiry may be passed to the appropriate totalisator by transaction processing and subscription management system 24. If the user is charged a fee for subscribing to the service, the service may debit the fee from the user's account at the transaction processing and subscription management system 24.

The accounts at totalisators 30 and transaction processing and subscription management system 24 are typically maintained separately, because the business entities that operate totalisators 30 and transaction processing and subscription management system 24 are independent. If desired, financial functions related to opening and maintaining user accounts and the like may be handled using computer equipment at another location such as one of financial institutions 38 or other location remote from totalisators 30 and system 24. Such financial functions may also be implemented primarily at a totalisator 30 or primarily at the transaction processing and subscription management system 24 if desired.

Users at user television equipment 22, user computer equipment 20, and user telephone equipment 32 may place wagers by providing wagering data and otherwise interacting with transaction processing and subscription management system 24. The interactive wagering service may provide a user at user television equipment 22, user computer equipment 20, or user telephone equipment 32 that has display capabilities with screens containing various racing data. For example, the user may be presented with screens that allow the user to view the current odds for horses in an upcoming race at a given track.

The service may provide the user with interactive screens containing menus and selectable options that allow the user to specify the type of wager in which the user is interested and the desired wager amount. With an electronic book arrangement, for example, the user may press dedicated buttons on the electronic book or may select on-screen options by touch or by using handwriting recognition. With a set-top box arrangement, the user may use a remote control or wireless keyboard to navigate the various menus and selectable options. With a personal computer, the user may use a keyboard, mouse, trackball, touch pad, or other suitable input or pointing device. With a cellular telephone with a display, the user may use buttons on the telephone. When the user has made appropriate selections to define a desired wager, the user television equipment, user computer equipment, or user telephone equipment may transmit wagering data for the wager to transaction processing and subscription management system 24.

Users with telephones may also interact with the service using an interactive voice response system located at transaction processing and subscription management system 24. The interactive voice response system may present menu options to the user in the form of audio prompts (e.g., "press 1 to select a $2 wager amount," etc.). The user may interact with the service be pressing the corresponding buttons on a touch tone telephone. User telephone equipment 32 that is based on cellular telephones allows the user to interact with the wagering service in this way. User telephone equipment 32 that is based on cellular telephones with messaging and display capabilities also allows the user to interact visually with the interactive wagering service.

The components of system 10 may be interconnected using various communications paths 44. Communications paths 44 may include satellite paths, coaxial cable paths, fiber-optic paths, twisted pair paths, other wire or cable-based links, wireless paths through free space, or any other suitable paths or combination of such paths. Communications over paths 44 may involve analog transmissions, digital transmissions, wireless transmissions, microwave transmissions, radio-frequency transmissions, optical transmissions, audio transmissions, or any other suitable type of transmissions or combination of such transmissions. Communications may involve Internet transmissions, private network transmissions, packet-based transmissions, television channel transmissions, transmissions in the vertical blanking interval of a television channel or on a television sideband, MPEG transmissions, etc. Communications may involve wireless pager or other messaging transmissions. Communications paths 44 may include cable connected to cable modems, digital subscriber lines, integrated services digital network (ISDN) lines, or any other suitable paths. Examples of suitable communications paths are described below. Those examples are, however, merely illustrative. Any of the communications path arrangements described above or other suitable arrangements may be used if desired.

Communications paths that carry video and particularly uncompressed analog video or lightly-compressed or full-screen digital video generally use more bandwidth than communications paths that carry only data or that carry partial-screen digital video. For example, if it is desired to transmit high-quality simulcasts of races from racetracks 12 to video production system 14, analog or digital videos may be transmitted from racetracks 12 to video production system 14 over path 44*a* using satellite links. Video may be transmitted from studio 16 to video production system 14 over path 44*b* using a satellite link or a high-speed terrestrial path such as a fiber-optic path. Studio 16 may also be located at the same site as video production system 14, thereby avoiding the need for a long-haul transmission path. Videos may be transmitted from video production system 14 to user computer equipment 20 over path 14*c* using a modem link (using, for example, a digital subscriber line, a telephone network link, a wireless link etc.) The modem link may be made over a private network.

A user with a cable modem may connect a personal computer or other user computer equipment 20 to an associated cable system headend using path 44*d*. (The headend in such an arrangement would be one of the television distribution facilities 18 shown in FIG. 1.) The user may then receive videos from the headend via cable modem. Videos may be provided to the headend over path 44*e* using a network link, fiber optic links, cable links, microwave links, satellite links, etc. A user with a set-top box or similar device (shown in FIG. 1 as user television equipment 22) may also receive videos from a cable system headend using a cable modem or other such communications device over path 44*f*. In addition, a user with user television equipment may receive videos over the Internet or a private network using a telephone-based modem or other such communications device using path 44*g*. In a system with distributed processing, interactive wagering services may be provided using a television distribution facility 18 that includes equipment that supplements or replaces at least some of the equipment at transaction processing and subscription management system 24.

If desired, user television equipment 22 or user computer equipment 20 may receive analog or digital videos from an associated television distribution facility over the communications paths normally used to distribute television programming (e.g., paths 44*f* and 44*d*). For example, videos may be received as part of a dedicated interactive wagering service television channel. If videos are provided as digital signals (e.g., MPEG signals), 10 or more digital videos may be carried on a single analog channel (or one digital video may be carried on one-tenth of the bandwidth of an analog channel). If the videos are not full-screen videos, even more videos may be simultaneously provided without a loss of image quality.

Racing videos may be provided to user telephone equipment 32 over a partially-wireless telephone Internet link or other telephone link using path 44*n*.

If desired, racing data may accompany the racing videos along any of these paths. Moreover, racing videos may be provided by routing them directly from racetracks 12 to user television equipment 22, user computer equipment 20 (e.g., over the Internet or a private network, etc.), or user telephone equipment 32. Racing videos may also be provided by routing them through transaction processing and subscription management system 24. If a cellular telephone or portable computing device has sufficient display capabilities to support moving images, racing videos may be displayed. Such videos may be provided using any suitable path, such as a direct path from racetracks 12, a path through video production system 14 or other suitable video processing equipment, through a hub such as transaction processing and subscription management system 24, etc. Racing videos may be provided in real time or may be recorded for later distribution. Videos that are not provided in real-time may be downloaded by user television equipment 22, user computer equipment 20, a cellular telephone, or other suitable user equipment at a lower data rate than would otherwise be required and may be downloaded in the background if desired. Such videos may also be provided to the user at real-time video rates for direct viewing by the user.

Racing data and other information related to the interactive wagering service may be provided to users over paths connected to transaction processing and subscription management system 24. For example, racing data and other data for the service may be provided to user computer equipment 20 over path 44*h* using a modem link. Path 44*h* may be a private network path or an Internet path. Path 44*h* may use telephone lines, digital subscriber lines, ISDN lines, wireless data paths, or any other suitable type of communications links. User television equipment 22 may receive data for the wagering service over communications path 44*i*, which may be a telephone line, digital subscriber line, ISDN line, or other suitable type of communications path and which may use a private network path or an Internet path, etc.

Data for the wagering service may be provided to users of the interactive wagering application via communications path 44*j* and paths 44*f* and 44*d*. Communications path 44*j* may be provided over a private network, using the public telephone network, using satellite links, or any other suitable type of links. Data from paths such as path 44*j* may be routed to paths such as paths 44*f* and 44*d* directly by associated television distribution facilities 18, or may be buffered at television distribution facilities 18 if desired. Paths 44*f* and 44*d* may include coaxial cable and use of paths 44*f* and 44*d* may involve the use of cable modems or the like. If data is provided over path 44*j* and path 44*f* or path 44*d* using an Internet protocol, a web browser or similar software running on user television equipment 22 or user computer equipment 20 may be used to access the data. Such software may be integrated into the interactive wagering application or may be used separately. Software may also be used to view videos and may be used on other platforms (e.g., advanced cellular telephones) if desired.

The communications paths 44*k* that are used to connect various other components of the system typically do not carry high-bandwidth video signals. Accordingly, paths 44*k* may be telephone-like paths that are part of the Internet or a private network. Such paths and various other paths 44 may be dedicated connections for security, reliability, and economy.

User telephone equipment 32 may receive information for the wagering service via path 44*m*. If user telephone equipment 32 is a standard (noncellular) telephone, such information may be in the form of audio prompts ("press 1 to place a wager") and audio racing data ("the current win odds for horse 2 are 5–1"). Transaction data processing and subscription management system 24 may contain interactive voice response equipment that provides such information to the user and that responds to touch-tone signals from the user when the user responds to prompts by pressing buttons on the user's telephone.

If user telephone equipment 32 is a cellular telephone, racing data and other information for the interactive wagering service may be provided to the user by using a cellular wireless connection as part of path 44*m*. Users with cellular telephones may be provided with audio prompts using an interactive voice response system located at transaction processing and subscription management system 24 to which the users may respond by pressing cellular telephone buttons to generate touch-tone signals.

Racing data and other information for the interactive wagering service may be provided to cellular telephones in the form of alphanumeric messages. Such messages may be transmitted to the user by using paging or other alphanumeric messaging formats or any other suitable data communications scheme. If desired, data may be provided to the cellular telephones over the voice channel and decoded by the cellular telephone using modem circuitry or other suitable circuitry. Data may also be provided using any other suitable cellular or wireless path. Regardless of the way in which racing data and other information for the interactive wagering service are provided to the cellular telephone, such information may be provided to the user by displaying it on the cellular telephone display screen or by presenting it in audible form through the speaker of the cellular telephone.

Racing data and other interactive wagering service information for the users may be provided in one or more continuous data streams, may be provided periodically (e.g., once per hour or once per day), or may be provided using a client-server arrangement in which data is requested by a client processor (e.g., user television equipment 22, user computer equipment 20, user telephone equipment 32, or any other such equipment) from a server (e.g., a server implemented using computer equipment 26 at transaction processing and subscription management system 24 or computer equipment at another suitable location). Videos may also be provided using any of these techniques.

A return communications path between the user and the interactive wagering service may be used to allow the user to place wagers and otherwise interact with the interactive wagering service. For example, a user with a standard telephone or a cellular telephone may interact with the service by pressing touch-tone keys on the telephone in response to audio prompts provided by an interactive voice response system at transaction processing and subscription management system 24. If desired, users may call customer service representatives at customer service facility 36 and place wagers with manual assistance. The user of a cellular telephone may interact with the wagering service by selecting menu options and otherwise interacting with information displayed on the cellular telephone. When a selection is made, software implemented on the telephone may be used to assist the user in transmitting appropriate data (e.g., wagering data) to the wagering service. Such data may be transmitted using any suitable technique. For example, data may be transmitted using a wireless data link that is separate from the cellular voice channels. Data may also be transmitted over the voice channel (e.g., using a modem built into the cellular telephone, by automatically generating touch-tone signals that may be recognized by the interactive voice response system at transaction processing and subscription management system 24, or using any other suitable arrangement). These approaches may be used even if the user receives racing data and other information for the service using a platform other than a telephone-based platform.

Users with user television equipment 22 may interact with the service by sending data (e.g., wager data) to transaction processing and subscription management system 24 using path 44*i* or using paths 44*f* and 44*j*. Users with user computer equipment 20 may send data (e.g., wager data) to transaction processing and subscription management system 24 via path 44*h* or paths 44*d* and 44*j*. Users at any user equipment may send data for the service to locations other than transaction processing and subscription management system 24. For example, the user may provide information directly to customer service facility 36, etc.

If desired, the user may send data to the service at transaction processing and subscription management system 24 using different paths than those used to receive data from transaction processing and subscription management system 24. For example, racing data may be received at user television equipment 22 via paths 44*j* and 44*f*, whereas data may be sent by the user from user television equipment 22 to transaction processing and subscription management system 24 using path 44*i*, etc. Moreover, the paths used to receive certain video information may be different from those used to receive racing data. For example, user television equipment 22 may receive racing videos using path 44*f*, but may receive racing data using path 44*i*. These examples are merely illustrative. Any suitable combination of paths may be used to distribute racing data and other information for the interactive wagering service, any suitable combination of paths may be used to receive videos, and any suitable combination of paths may be used to send data to the wagering service.

If desired, the user may interact with the wagering service using more than one platform. For example, the user may place a wager using a cellular telephone while the user is driving home. When the user arrives home, the user may determine the outcome of the wager by watching a video of the race on user television equipment. Later in the day, the user may check the user's account balance using a personal computer. This is merely an illustrative example. The various wagering platforms may be used in any suitable combination.

Although system 10 has been described in the context of a system that supports multiple wagering platforms, system 10 may support fewer platforms if desired. For example, aspects of the invention may be implemented using a system 10 that only supports wagering from electronic books. If desired, system 10 may be configured so that it does not support wagering with telephone or television equipment. The system may support electronic books, cellular telephones and/or handheld computing devices such as personal digital assistants, palm-sized computers, etc. in combination with any other suitable platforms.

The features of the present invention are described herein primarily in the context of an interactive wagering application implemented on user computer equipment such as an electronic book. This is only illustrative. An interactive wagering application implemented on any suitable platform (user computer equipment, user television equipment, user telephone equipment, etc.) may be used to provide such features if desired. In electronic book arrangements, on-screen options may be selected by touch (if the electronic book supports a touch-screen interface) or by using a highlight region or on-screen pointer or the like. In set-top box arrangements, on-screen options may be made larger than they appear in computer-based arrangements to accommodate the greater viewing distance from which televisions are typically operated. Options may be selected by highlighting them using remote control arrow keys and by pressing an appropriate key such as an OK or enter or select key. In cellular telephone arrangements and handheld computer arrangements, options and information may be displayed using smaller screens than are typically available on personal computer or set-top box arrangements. To accommodate the smaller screen size, options that might otherwise be presented on a single screen may be displayed using multiple screens or layered menus. Options may be selected by highlighting them using navigation keys and pressing an appropriate select button on the cellular telephone or handheld computing device or by using a pen-based interface or the like.

The interactive wagering application may be implemented using application software that runs primarily on user television equipment, user computer equipment, user telephone equipment, or another local platform, or using a remote server or other computer that is accessed from the local platform. Arrangements in which interactive wagering services are implemented using software on remote computers that is accessed on-demand from local platforms may be referred to as client-server arrangements. Such client-server arrangements may be used to allow client processes on set-top boxes or other platforms to access server processes running on servers located at cable system headends or other television distribution facilities 18 (FIG. 1). Regardless of the type of system architecture or platform used, the software that supports the interactive wagering service features described herein may be referred to as an interactive wagering application.

In a set-top box environment, the system may allow the user to launch the application by selecting a menu option in an interactive television program guide or other set-top box application or menu. If desired, the application may be launched automatically whenever the user tunes to a particular channel (e.g., the television wagering channel). After the user has tuned to this channel, the system may display an interactive icon on the user's television screen that indicates that the interactive wagering application is available. If the user presses an "OK" remote control key, the system may launch the application.

In a computer-based system, the user may access the interactive wagering application by browsing to an Internet web site or a site on a private network or by otherwise connecting to computing equipment such as computing equipment 26 of transaction processing and subscription management system 24 (FIG. 1) or other suitable computer equipment.

Systems based on cellular telephones or the like may be launched by selecting an appropriate on-screen menu option presented on the display of the cellular telephone.

Figure 2:
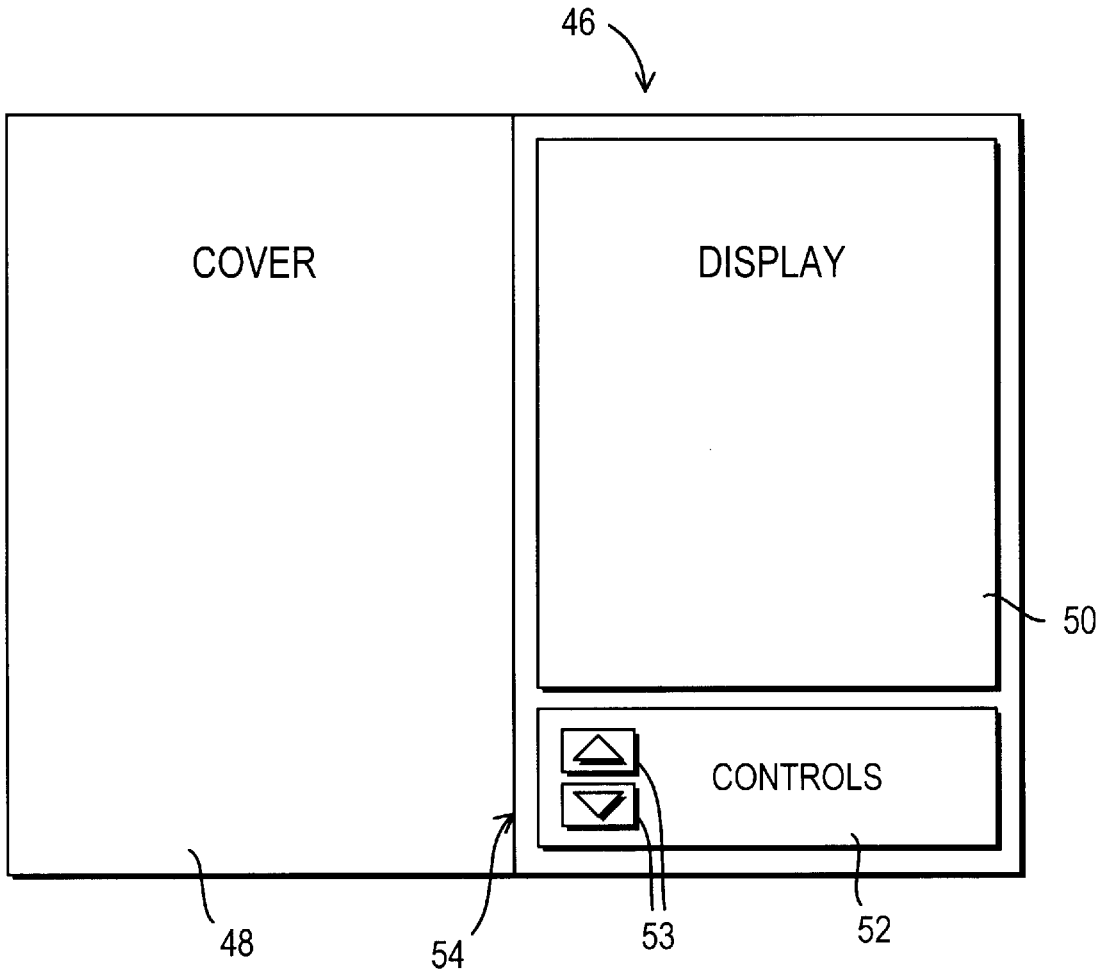
FIG. 2 is a plan view of an illustrative electronic book in accordance in accordance with the present invention.

An illustrative electronic book 46 or eBook is shown in FIG. 2. Electronic book 46 may be any suitable electronic book, such as the SoftBook® Reader of Softbook press, Redwood City, Calif. or hardware based on a platform such as the SoftBook Reader platform. Electronic book 46 may have a cover such as cover 58. Cover 48 may be formed out of leather or plastic or any other suitable protective material.

Electronic book 46 may also have a display 50. Display 50 may be any suitable display capable of displaying information to a user. For example, display 50 may be a back-lit black and white or color liquid crystal display (LCD). Display 50 may be a touch-screen, so that a user may select on-screen options that are displayed on display 50 by touching them. The size of display 50 may be selected to be comparable to that of a sheet of paper (e.g., roughly 8½ inches by 11 inches). This is merely illustrative. Any suitable size may be used for display 50 if desired.

Controls 52 may allow the user to interact with electronic book 46. Controls 52 may include page navigation buttons 53 that allow the user to page forward and backward through material displayed on display 50. Buttons 53 may be provided as on-screen buttons or as dedicated keys or as any other suitable control mechanism. If desired, buttons may be used to invoke a menu, to make selections, to turn on and off the power for electronic book 46, to allow the user to use a pen or other input device (e.g., using handwriting recognition), etc.

Hinge 54 may be used to close cover 48 on top of display 50. A clasp or other fastener may be used to secure cover 48 when it is in the closed position. If desired, electronic book 46 need not use cover 48 or hinge 54.

Figure 3:
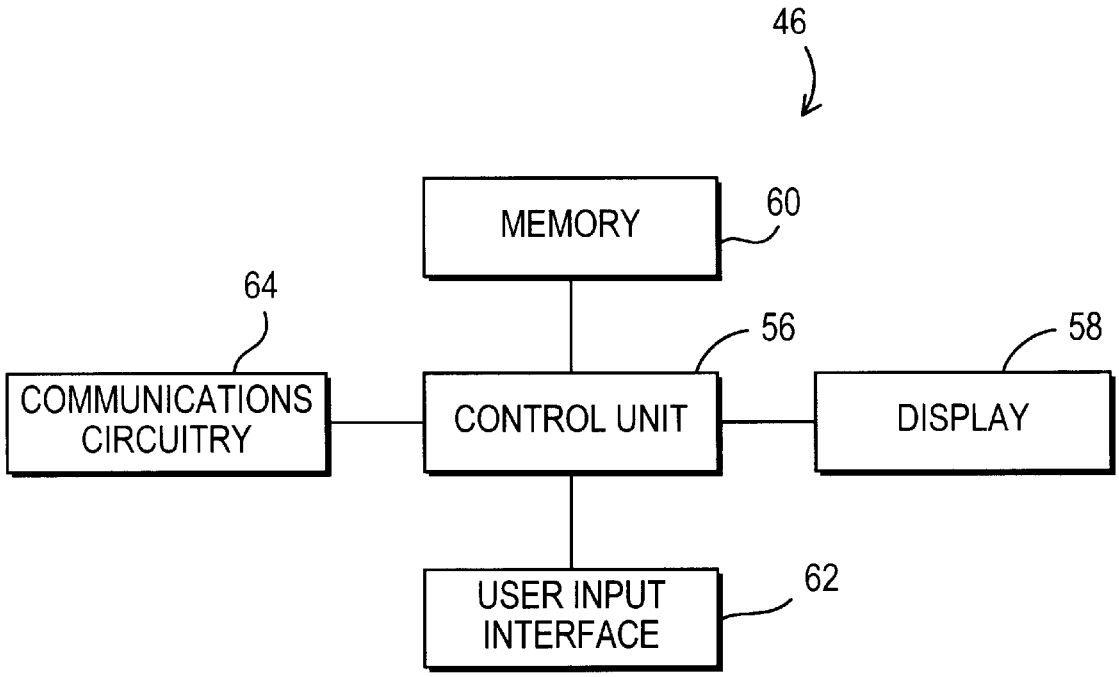
FIG. 3 is a schematic diagram of an illustrative electronic book in accordance with the present invention.

A schematic diagram of an illustrative electronic book 46 is shown in FIG. 3. The operation of electronic book 46 may be supported using control unit 56. Control unit 56 may be any suitable microprocessor-based or microcontroller-based control circuitry.

Information for the user may be displayed on display 58. Display 58 may be any suitable type of display, including LCD displays, color displays, monochrome displays, plasma displays, etc.

The user may interact with electronic book 46 using user input interface 62. User input interface 62 may be any suitable interface that allows the user to interact with electronic book 46, such as a pointing device (e.g., mouse, trackball, touch pad, etc.), keyboard (on-screen keyboard, dedicated keyboard, wireless keyboard), key pad, buttons (e.g., dedicated or multipurpose bottons), handwriting recognition apparatus, voice recognition apparatus, etc. As an illustrative example, electronic book 46 may have buttons that allow the user to start electronic book 46, to turn pages in electronic book 46, to highlight or otherwise indicate an interest in an on-screen item, to select items (e.g., after they are highlighted), etc.

Memory 60 may be any suitable storage device such as random-access memory (RAM), read-only memory (ROM), a removable flash memory or the like, a hard disk drive, or any other suitable storage media. As an illustrative example, electronic book 46 may have solid state memory only (e.g., RAM and ROM), but not a hard disk drive. Memory 60 may be used to store downloaded material such as books, magazines, etc.

Communications circuitry 64 may be used to communicate with computing equipment such as computer equipment 26 of FIG. 1. Communications circuitry 64 may be wired communication circuitry (e.g., a 56k modem or cable or DSL or ISDN modem). Communications circuitry 64 may also be wireless communications circuitry. For example, communications circuitry 64 may support radio-frequency wireless communications between electronic book 46 and a cellular telephone tower or other wireless base station. Communications circuitry 64 may allow electronic book 46 to communicate with the other components of system 10 using the paths that are shown as being connected to user computer equipment 20 in FIG. 1.

If desired, communications circuitry 64 may support wireless communications between electronic book 46 and a device such as a set-top box or personal computer in the home. Such wireless communications may use, for example, the Bluetooth protocol. In arrangements such as these, electronic book 46 may be a part of user computer equipment 20 and may communicate with a personal computer in the home that is connected to the components of system 10 of FIG. 1 using the paths that are shown in FIG. 1 as being connected to user computer equipment 20 or electronic book 46 may be part of user television equipment 22 and communicate with a set-top box in the home that is connected to the components of system 10 of FIG. 1 using the paths that are shown in FIG. 1 as being connected to user television equipment 22.

Figure 4:
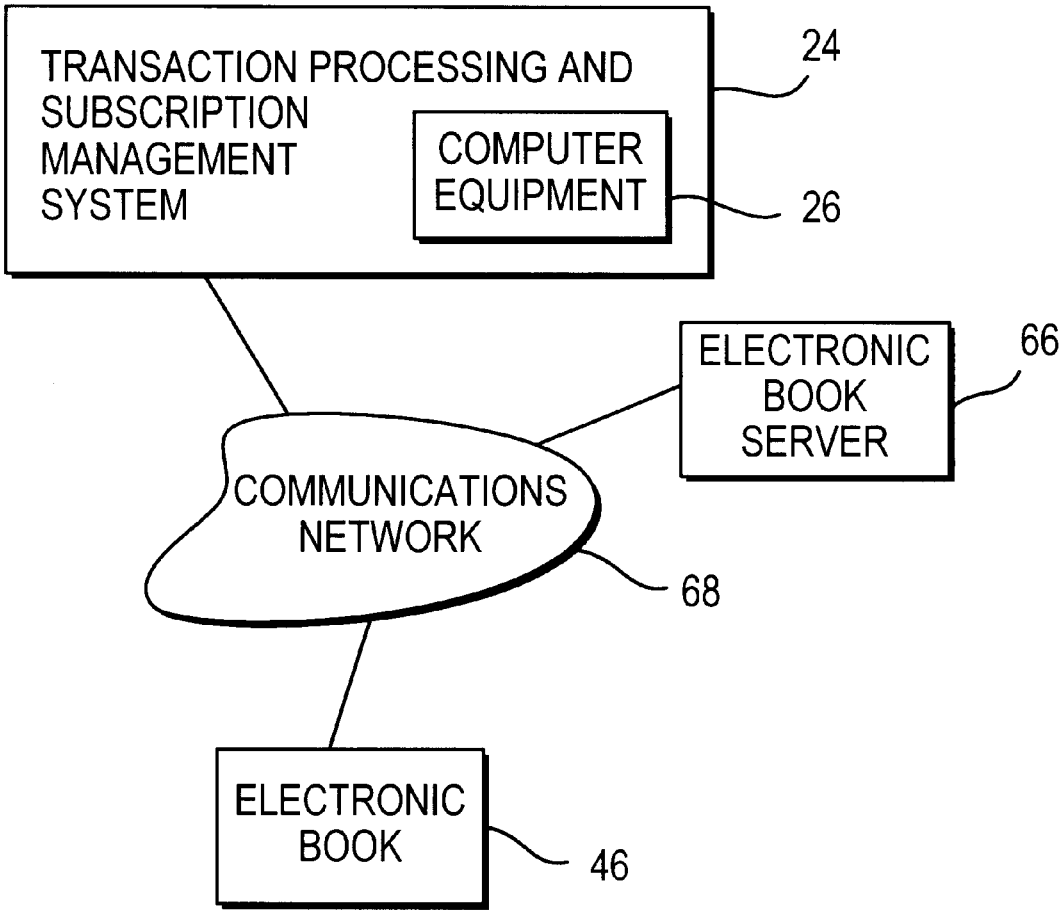
FIG. 4 is a schematic diagram showing how an electronic book may interact with an interactive wagering system and a source of electronic book content in accordance with the present invention.

Electronic book 46 may receive content electronically from an electronic book web site or any other suitable source of electronic information. For example, as shown in FIG. 4, electronic book 46 may receive racing data or other information from an electronic book server 66 or other computing equipment over a communications network 68. Communications network 68 may be any suitable communications network, including the telephone network, the Internet, etc. Electronic book 46 may, for example, use an internal modem to connect to a web site for downloading electronic material that is provided by server 66 over the telephone network.

Electronic book 46 may also access computer equipment 26 in transaction processing and subscription management system 24 over communications network 68. This allows electronic book 46 to receive racing data and other information from computer equipment 26. Electronic book 46 may also be used to place wagers electronically with transaction processing and subscription management system 24.

One type of content that electronic book 46 may download is a racing form. The racing form may contain handicapping information such as information on the past performances of various horses. The racing form may be provided to electronic book 46 using an electronic book server such as electronic book server 66 or may be provided by any other suitable computer equipment. For example, the racing form may be provided by computer equipment 26 of transaction processing and subscription management system 24. The racing data for the racing form may be provided to computer equipment 26 from any suitable source of racing data such as racing data collection and processing system 28 of FIG. 1.

Figure 5:
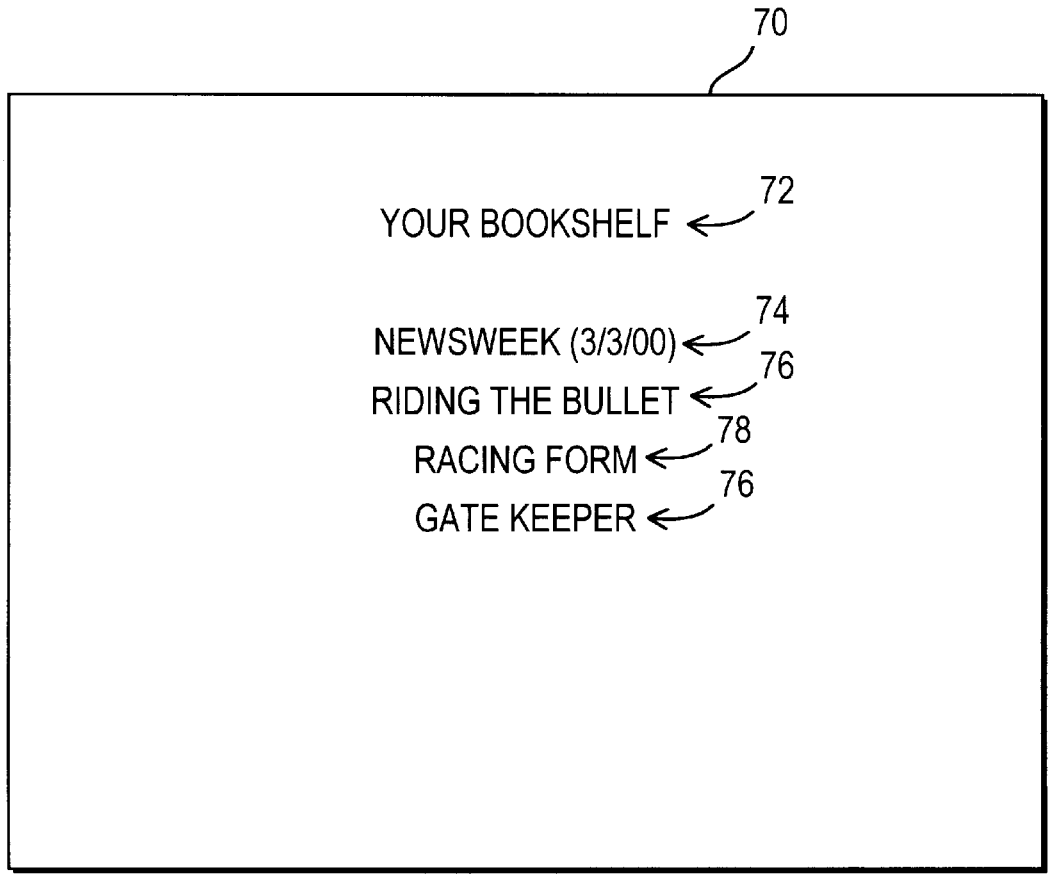
FIG. 5 shows an illustrative electronic book content selection menu that may be provided in accordance with the present invention.

When electronic book 46 is used to access an electronic book server such as electronic book server 66, a menu such as menu 70 of FIG. 5 may be displayed on the display of electronic book 46. Menu 70 may contain title information 72 and various selectable options. Option 74 may be used to provide the user with an opportunity to download an electronic copy of Newsweek. Options 76 may be used to download books. Racing form option 78 may be selected when the user is interested in downloading a racing form.

If desired, the user may obtain the racing form electronically from computer equipment 26 of transaction processing and subscription management system 24. If the racing form is obtained from computer equipment 26, it may not be necessary to provide a menu such as menu 70 that includes options related to obtaining content other than the racing form.

As shown in FIG. 6, when the user selects option 78 of menu 70, the user may be presented with a racing form 80 that is an electronic replica of a printed racing form. Racing form 80 may be presented using a format such as the PDF format or any other suitable format.

The layout of racing form 80 of FIG. 6 is merely illustrative. Any suitable racing form layout may be used. In most instances, however, racing form 80 will contain at least some of the different types of information presented on form 80 of FIG. 6.

Racing form 80 of FIG. 6 includes information 82 identifying a given racetrack (e.g., Turfway Park), information 84 identifying a particular race at the given racetrack (e.g., race No. 1). Information 86 on the name of each horse scheduled to run in the race may also be provided.

Information 88 may be provided on the conditions of the race. Information 90 may be provided on the length of the race. Information 92 may be provided regarding the jockey and owner. Information 94 may be provided on the claiming price for claiming races. Information 96 may be provided on the physical specifications and breeding of each horse. Summary information 98 may be provided on each horse's yearly and lifetime past performances. For example, information may be provided on each horse's lifetime winnings and win, place, and show statistics.

Information 100 may be provided on each horse's medication (e.g., whether or not Lasix is being administered to the horse). In each race, information 102 may be provided on the minimum total weight that each horse must carry in the race.

Information 104 may also be included on the past performances of each horse. For a particular horse (e.g., Laura B in the example of FIG. 6), each line of past performance information 104 corresponds to a particular past race. Information in each line includes the date of the race (e.g., Mar. 8, 2000), race and track code information (e.g., "5TP" stands for the fifth race at Turfway Park), track conditions (e.g., fst for fast, sly for sloppy, etc.), the lead horse's split times, etc.

Racing form 80 may also contain information on horses that fall into certain predefined categories. For example, category 104 (Best Beyer at the Track) may include information 105 on the horse (e.g., Walnut Springs) who has previously attained the highest "Beyer" speed rating at the current track (e.g., Turfway Park). Categories 106, 108, and 110 also have corresponding information 107, 109, and 111 indicating which horses match the criteria of those categories. Category 106 is for the horse that has the best speed rating for the given distance of the race (regardless of which track was involved). Category 108 is for horses that have the best records at the given distance for the race at the same racetrack. Category 110 provides information 111 on any horses that are returning to their first race after a layoff (e.g., an interval of more than 45 days without racing). Other suitable categories include "second race off layoff," "highest win % this track and meet," "highest % in money last 12 starts," and "highest earning/star last 12 starts." These categories are merely illustrative. Any other suitable categories may be provided.

The content of racing form 80 may be passive or interactive. If the content is passive, the user may be allowed to page through various pages of the racing form to view articles, advertisements, and racing data for various racetracks.

If the content is interactive, the user may select displayed items to obtain additional information or to create a wager based on the selected information. As an example, if the user selects information 88 on the race conditions, additional information may be presented to the user on the race conditions. The additional information may be, for example, a more detailed description of the race conditions or a glossary of the terms used in information 88. The additional information may also contain information that is organized as answers to frequently asked questions. The user may also be presented with additional information if, for example, the user selects information 90 (race length), information 98 (statistics), information 96 (breeding information), information 100 (medication), information 102 (jockey weight), information 94 (claiming amount), information 92 (jockey and owner information), or past performance information 104.

If the user selects one of categories 104, 106, 108, 110, or any other suitable category, information on the corresponding horses that fall into the selected category may be presented (if it is not already shown). With this type of arrangement, information such as information 105, 107, 109, and 111 may only be presented to the user after the user has selected a corresponding category 104, 106, 108, or 110.

When the user selects racetrack information 82, the user may be provided with an opportunity to create a wager at that racetrack. If the user selects race number information 84, the user may be provided with an opportunity to create a wager for the selected race at the racetrack (e.g., Turfway Park) for the selected race. If the user selects horse name information 86, the user may be provided with an opportunity to create a wager for the race (e.g., race No. 1) in which the selected horse is running. If desired, a default wager (e.g., a win wager) involving the selected horse may be automatically created. When the user selects options such as options 82, 84, or 86, the user is therefore allowed to bypass some of the wager creation screens that would otherwise be provided. These are merely illustrative arrangements. Any suitable arrangements for providing the user with an opportunity to create a wager upon selecting information contained in a displayed racing form such as racing form 80 may be used if desired.

Figure 7:
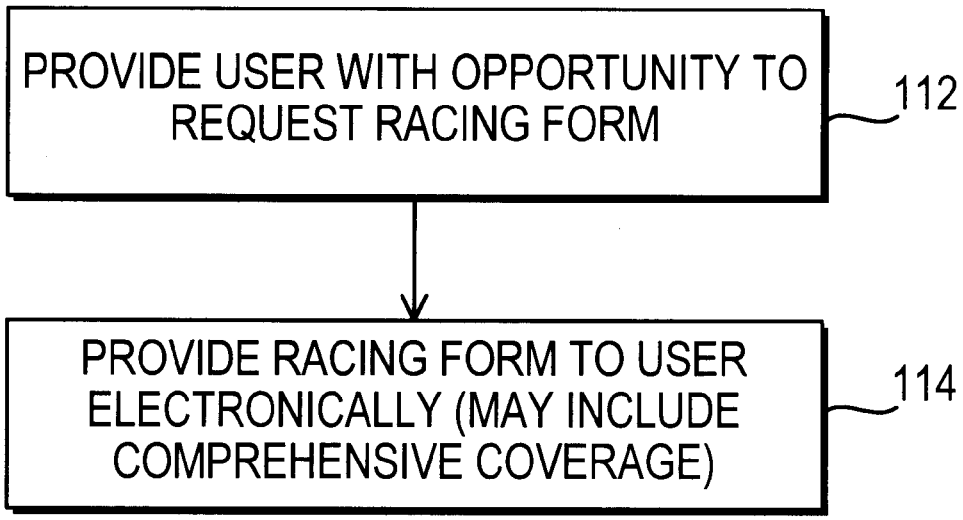
FIG. 7 is a flow chart of illustrative steps involved in electronically providing the user with a racing form in accordance with the present invention.

Illustrative steps involved in providing the racing form to the user are shown in FIG. 7. At step 112, the user may be provided with an opportunity to request the racing form. For example, the user may access a web site or otherwise access an electronic menu such as menu 70 of FIG. 5 over a communications network such as communications network 68 in FIG. 4 or other communications link (e.g., using a modem or other communications circuitry). The user may select an option such as option 78 of FIG. 5 or any other suitable on-screen option to request the racing form. The user's request may be passed to electronic book server 66 of FIG. 4 or computer equipment 26 or other suitable source of the requested racing form data.

At step 114, the user may be provided with the racing form electronically. The racing form may cover a single track, multiple tracks (e.g., grouped according to geography or time zone, user preference, etc.), or may cover a comprehensive grouping of all available tracks. Such a comprehensive group of tracks may include, for example, dozens of tracks from multiple time zones. The form may be downloaded from an appropriate source (e.g., electronic book server 66 or computer equipment 26 of FIG. 4 or any other suitable computing equipment) to electronic book 46 over communications network 68.

Figure 8:
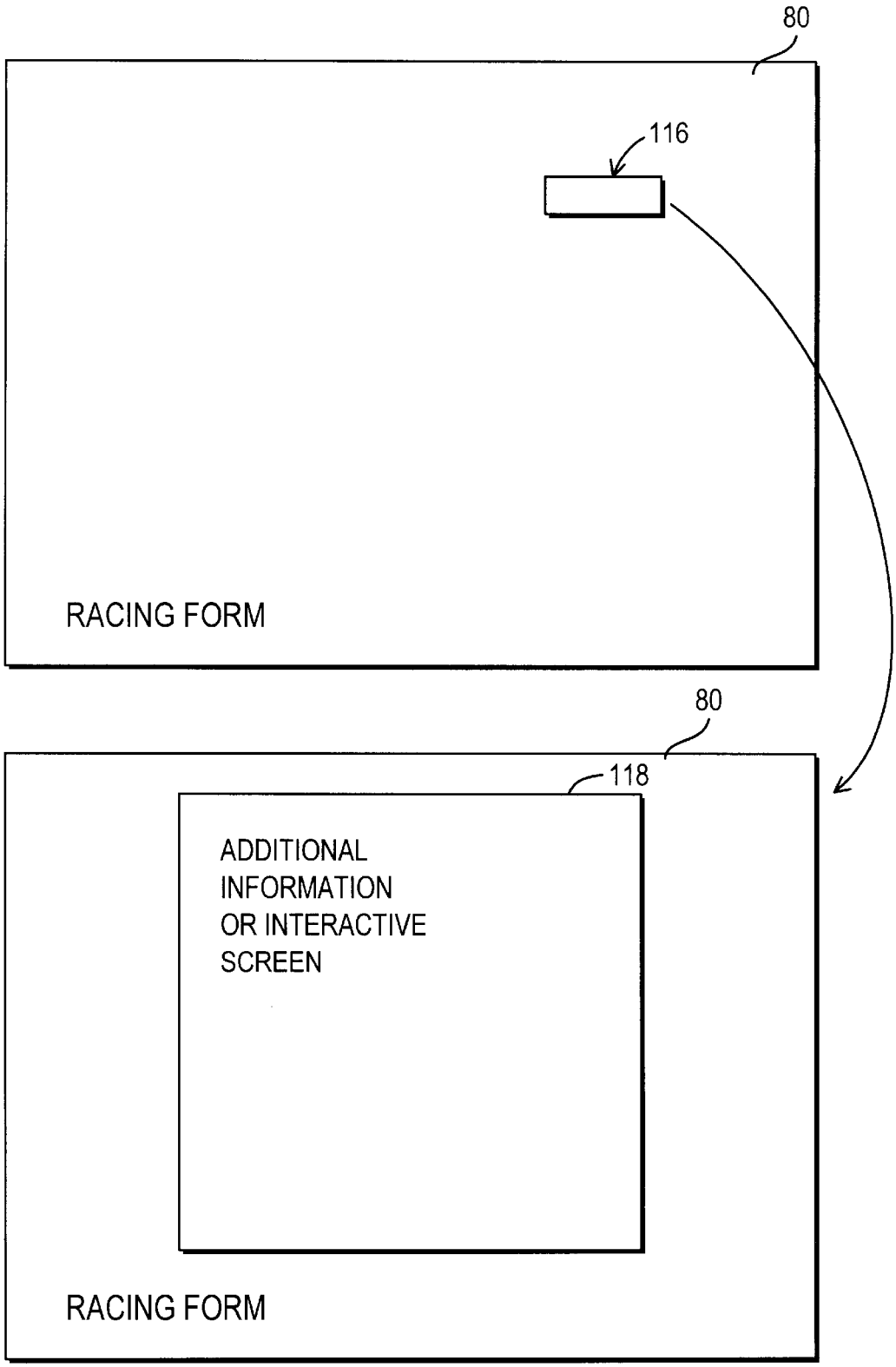
FIG. 8 shows how the racing form may be interactive in accordance with the present invention.

FIG. 8 shows how the racing form 80 may be interactive. When the user selects an item 116 on the racing form (e.g., an item of information such as a racetrack name, a past performance statistic, etc.), the user may be presented with additional information or an interactive screen in a region such as region 118 in the lower portion of FIG. 8. The additional information that may be provided may include information on the horse's history, additional information on the terms and codes used on racing form 80, additional handicapping data, a glossary, answers to frequently asked questions, or any other suitable additional information.

The user may be presented with an interactive screen in region 118 such as a wager-creation screen when, for example, the user has selected an item on racing form 80 such as racetrack information 82, race information 84, or horse information 86. The interactive screen (or associated screens) may contain options that allow the user to create a wager. Wager creation options may include a track selection option, a race selection option, a wager type selection option, a horse selection option, a wager amount selection option, and options for submitting wagers, reviewing wagers, etc. These options and the other options displayed by electronic book 46 may be provided as drop-down menus, as boxes to be checked off, or as any other user-selectable options. If desired, the interactive screen may be related to a non-wagering service.

The additional information or interactive screen shown in region 118 may be provided as a pop-up overlay on top of an existing full screen (e.g., as shown in FIG. 8), may be provided using a full-screen arrangement, or may be provided using any other suitable arrangement.

Figure 9:
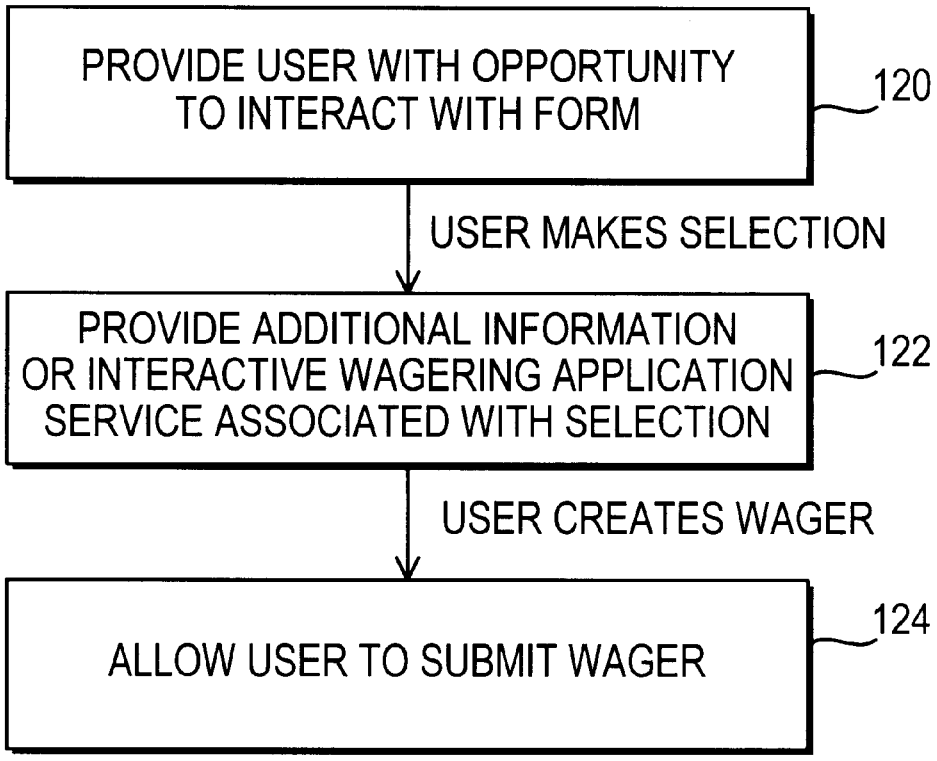
FIG. 9 is a flow chart of illustrative steps involved in using an interactive racing form in accordance with the present invention.

Illustrative steps involved in allowing the user to interact with a racing form such as form 80 of FIG. 6 are shown in FIG. 9. At step 120, the user may be provided with an opportunity to interact with racing form 80. For example, interactive on-screen options may be displayed on the display of the user's electronic book as part of the racing form 80.

At step 122, after the user has selected a desired option, additional information or an interactive wagering application service or other service that is provided using an interactive screen may be provided. For example, additional handicapping information may be displayed when the user selects information on a horse's performance, jockey and trainer, etc. Interactive wagering screens or other suitable interactive options may also be displayed when the user selects certain items on racing form 80. For example, screens that allow the user to create and place an electronic wager may be provided.

Wagers that are created using electronic book 46 may be submitted to transaction processing and subscription management system 24 (FIGS. 1 and 2) at step 124 over a suitable communications path (e.g., communications network 68 of FIG. 4 or an equivalent communications path such as communications path 44*h* or communications paths 44*d* and 44*j* of FIG. 1). Racing results may be provided to the user over the same type of communications path and the user's account may be credited or debited, as appropriate.

Figure 10:
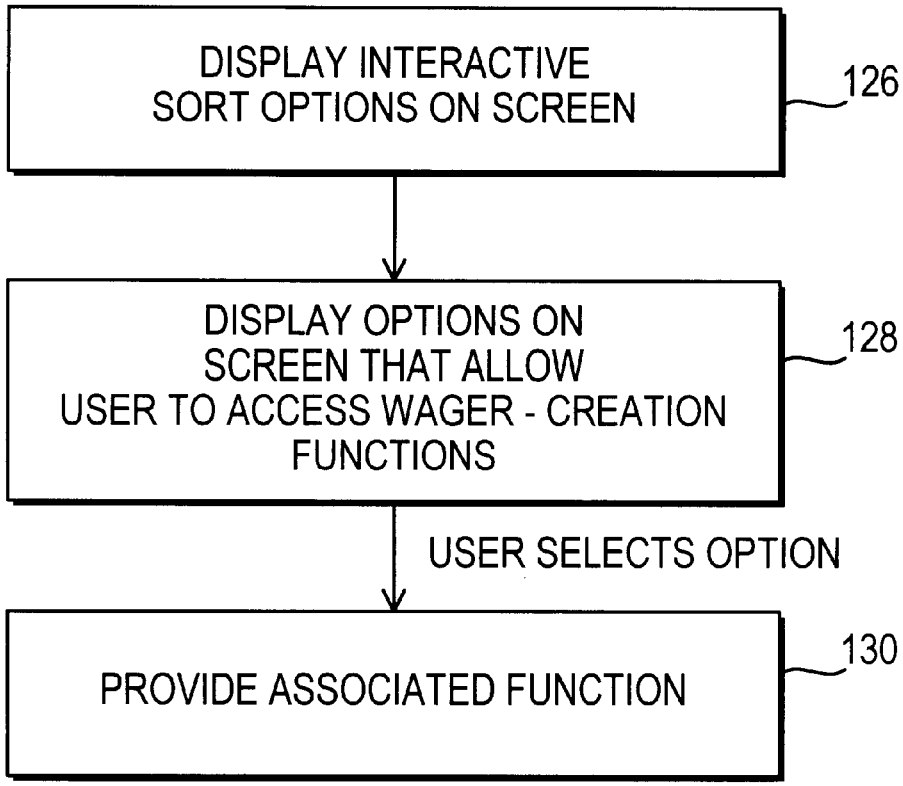
FIG. 10 is a flow chart of illustrative steps involved in providing various on-screen options to the user in accordance with the present invention.

As shown in FIG. 6, racing form 80 may contain information 105, 107, 109, and 111 that is organized by various categories 104, 106, 108, and 110. Illustrative steps involved in using electronic book 46 to present various on-screen options that may be used to organize handicapping information for the user are shown in FIG. 10. At step 126, various category options or other options that allow the user to sort or organize handicapping information may be displayed on the display of electronic book 46 as part of racing form 80. At step 128, on-screen options that allow the user to access wager-creation functions may be displayed on the display of electronic book 46 as part of racing form 80.

The user may select any of the displayed options. At step 130, the electronic book may be used to provide a function associated with the selected option. The function may, for example, involve displaying information that is organized according to a selected sort or category option. The function may also involve providing an interactive wagering service (e.g., to allow a user to create a wager, etc.).

Figure 11:
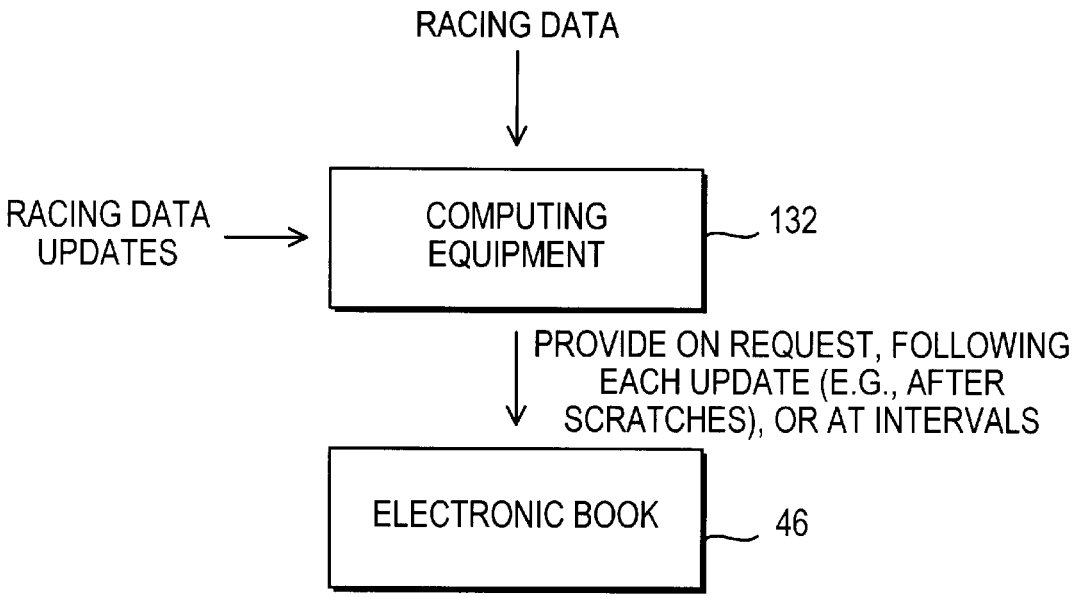
FIG. 11 is a diagram showing how data may be provided to user equipment in accordance with the present invention.

The user may be provided with racing data updates or the like. As shown in FIG. 11, for example, racing data updates may be provided to electronic book 46 through computing equipment 132 (e.g., computer equipment 26 of FIG. 1 or electronic book server 66 of FIG. 4). Racing data updates and racing data may first be provided to computing equipment 132 (e.g., from racing data collection and processing system 28 of FIG. 1 or any other suitable source of racing data). The racing data may be provided in the form of a racing form or any other suitable format. Racing data updates may also be provided in any suitable format. Racing data may be provided to electronic book 46 from computing equipment 132 on demand (e.g., when the user selects an option such as option 78 of FIG. 5) or according to a schedule (e.g., a user-defined or predefined schedule such as once per day, etc.).

Racing data updates may be necessary to provide information on late changes, scratches, late-breaking racing news, etc. Such updates may be provided on-demand (e.g., when the user downloads the racing form), following each update (e.g., whenever a significant event occurs that justifies releasing an update, or may be provided according to a predetermined schedule (e.g., every 15 minutes).

Figure 12:
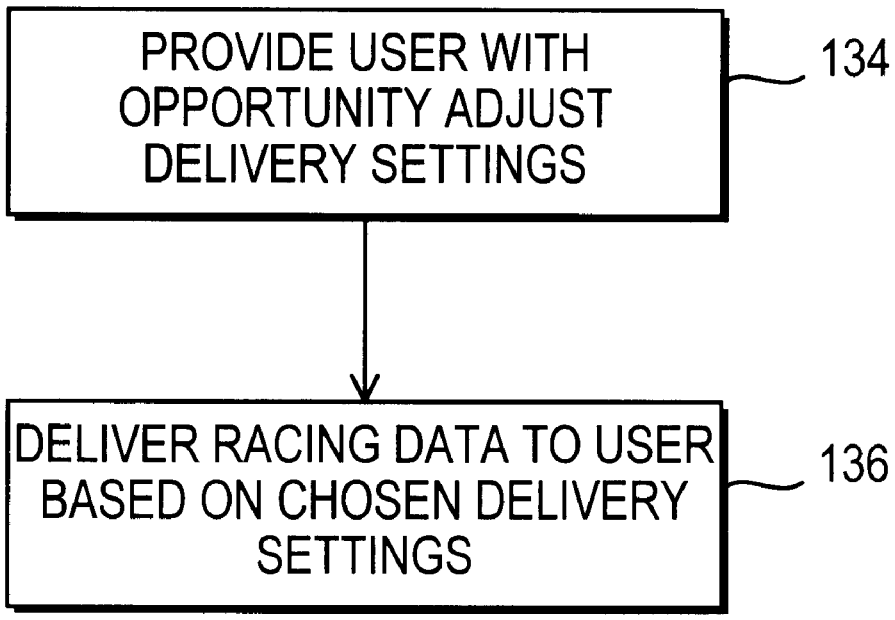
FIG. 12 is a flow chart of illustrative steps involved in allowing the user to adjust delivery settings for the delivery of racing data and other content delivery services in accordance with the present invention.

Illustrative steps involved in allowing the user to adjust delivery settings for racing data and updates are shown in FIG. 12. At step 134, the user may be provided with an opportunity to adjust delivery settings. For example, the user may be provided with on-screen options on the display of electronic book 46 that allow the user to set 15 minute delivery intervals for the racing data or any other suitable time periods or schedules.

At step 136, updated data may delivered to the user. The updated data may be delivered as a file or stream containing only the new data or may be delivered as a new version of previously-provided racing data. If desired, the update may be used to refresh the screen containing racing form 80, so that current information is displayed.

Figure 13:
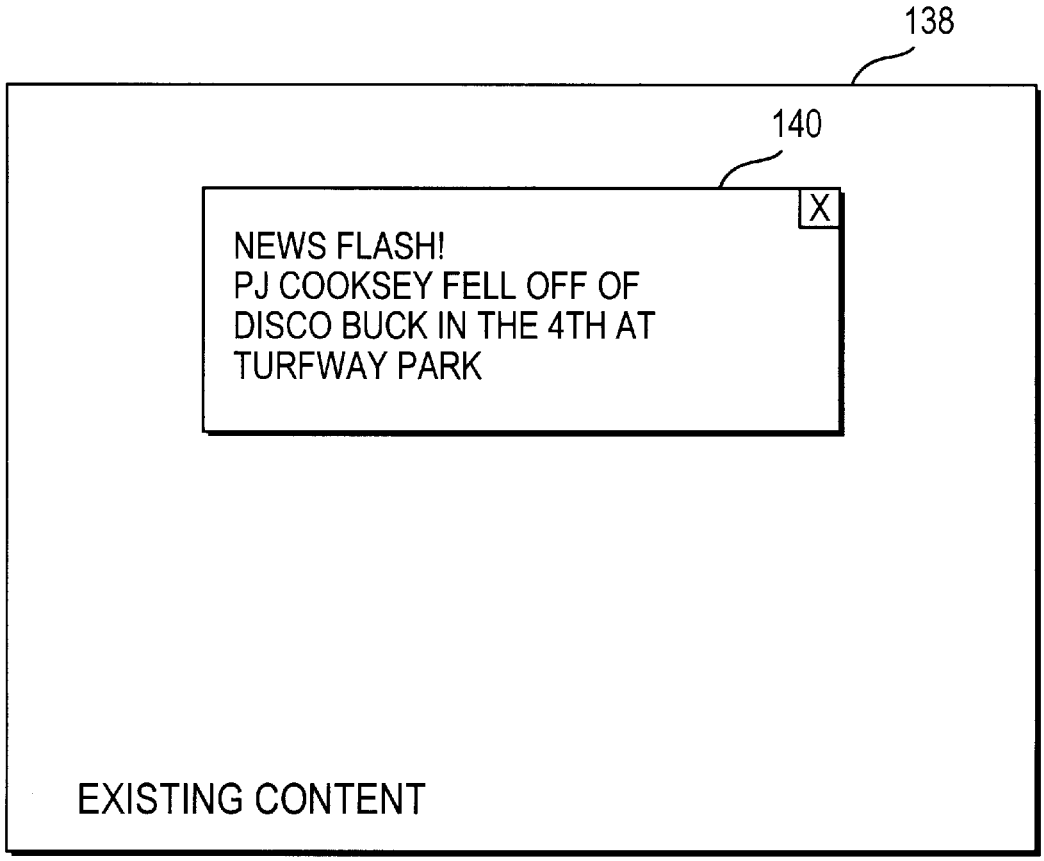
FIG. 13 shows how real-time news flashes may be provided to the user in accordance with the present invention.

Updated data may also be used to provide news flashes. News flashes may be provided as full screens on the electronic book 46 or may be provided as pop-up overlays on top of existing content. An illustrative screen 138 of existing content (e.g., a racing form, an electronic book, etc.) on which a news flash overlay 140 has been provided is shown in FIG. 13.

Any suitable racing-related or wagering-related information may be provided as an update or news flash. In the example of FIG. 13, the news flash concerns a fall taken by a jockey. This information is likely to affect the outcome of the race in which the jockey had been scheduled to participate. It is therefore information of interest to prospective wagerers on the race. By providing the news flash to users in real time, users may be kept up-to-date on last-minute news of this type.

Figure 14:
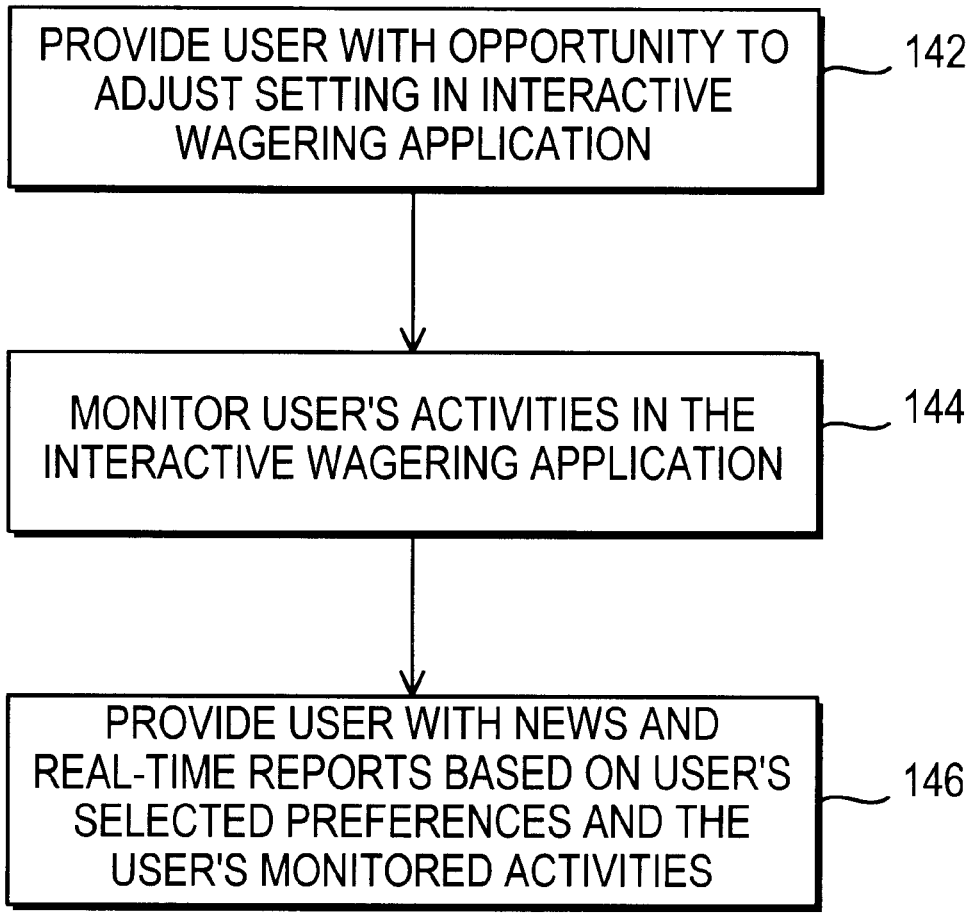
FIG. 14 is a flow chart of steps involved in providing the user with real-time reports based on the user's chosen settings and the user's activities in accordance with the present invention.

If desired, news flashes may be targeted to user's based on their interests. Illustrative steps involved in providing news and real-time reports to the user at electronic book 46 (e.g., from computing equipment such as computing equipment 132 of FIG. 11) are shown in FIG. 14. At step 142, the user may be provided with an opportunity to adjust various settings in the interactive wagering application to supply information on the user's preferences. For example, the user may be provided with on-screen options on the display of electronic book 46 that allow the user to specify a favorite track, favorite horses, default wager types and amounts, jockey preferences, or any other suitable race-related settings or preferences.

At step 144, the interactive wagering application may monitor the user's activities to determine the user's interests. For example, whenever the user places a wager, the interactive wagering application may store information (locally or on remote computing equipment) that allows the interactive wagering application to keep track of the user's wagering activities. When, e.g., the user places a wager, the interactive wagering application may store information on which horse the user has wagered on, which jockey was riding the horse, which length of race and type of wager the user selected, etc. The user's most current interests may be monitored by determining which wager the user is creating, has just created, or has just placed. Wagers that have been created but not placed may be maintained in a bet queue. The wagers in the bet queue may be analyzed to determine which horses, races, or tracks, and other criteria the user is interested in.

At step 146, the interactive wagering application or other suitable application may be used to provide the user with news and real-time reports based on the preferences set by the user and the user's monitored activities. For example, screens may be displayed on electronic book 46 in which news and real-time information has been incorporated. If desired, news and real-time reports may be provided based on either user preferences or monitored activities, rather than both. Moreover, any type of racing data update or racing-related information may be provided to the user in this way if desired.

Figure 15:
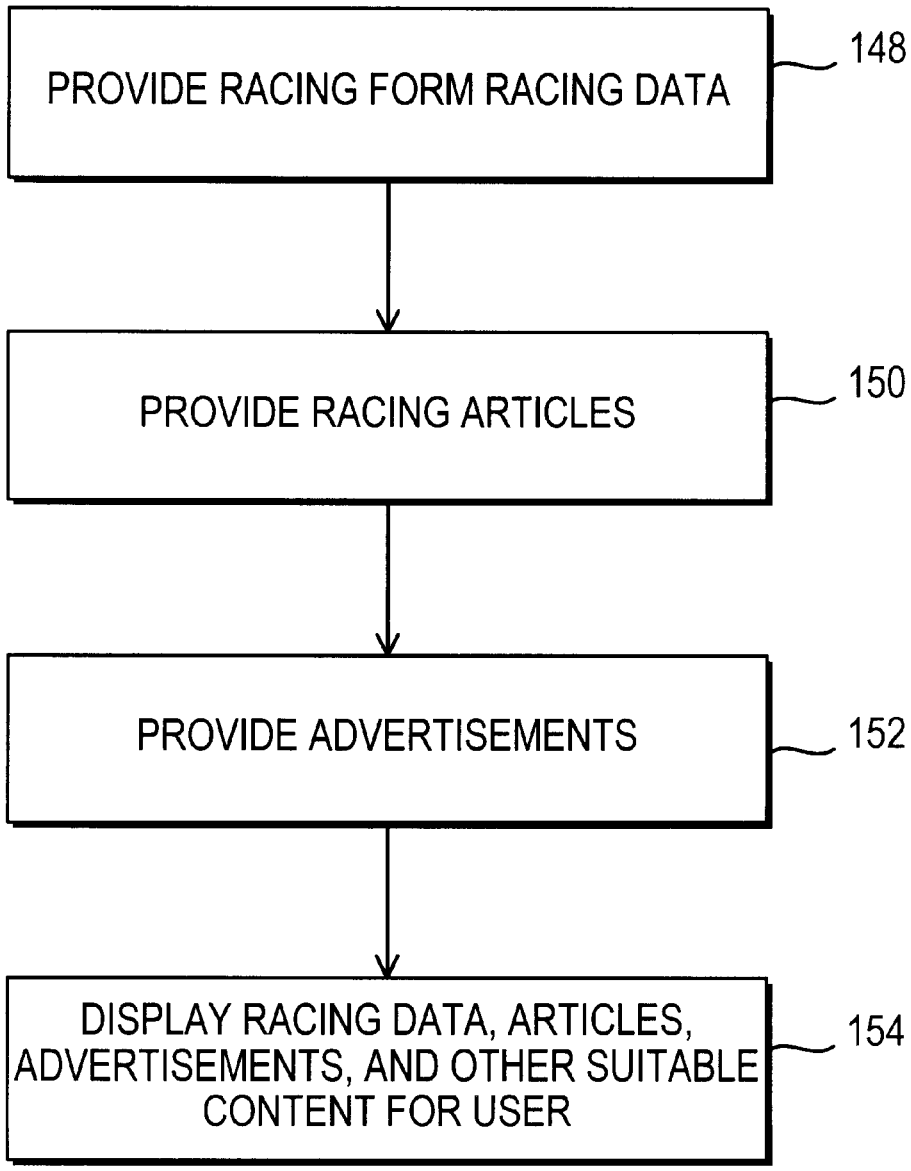
FIG. 15 is a flow chart of illustrative steps involved in providing content to the electronic book in accordance with the present invention.

The racing forms provided to electronic book 46 may include various types of content. Illustrative steps involved in providing the user with various types of content are shown in FIG. 15. At step 148, the user may be provided with racing data for the racing form. For example, racing data for the form may be distributed to the electronic book as shown in FIG. 4. At step 150, the user may be provided with racing articles. For example, articles may be provided on various racing-related subjects. At step 152, advertisements may be provided to the user. At step 154, racing data, articles, advertisements and other suitable content may be displayed for the user. For example, content of this type may be displayed on the display of electronic book 46 in the form of a racing form through which the user may navigate by turning the page using dedicated buttons on electronic book 46.

If desired, the features described in connection with electronic book 46 may be provided using any suitable user computer equipment 20, including notebook computers, handheld computers, etc. The features may also be provided using user television equipment 22 or user telephone equipment 32.

The foregoing is merely illustrative of the principles of this invention and various modifications can be made by those skilled in the art without departing from the scope and spirit of the invention.

What is claimed is:

1. A method for using an electronic book that has a display and page navigation buttons, comprising:

electronically downloading a racing form to the electronic book over a communications path, wherein the racing form is substantially similar to a printed racing form;

displaying the racing form on the display of the electronic book; and providing a user with an opportunity to interact with the racing form by selecting interactive on-screen options being displayed in the racing form.

2. The method defined in claim 1 further comprising:

providing a menu screen for the user that contains a list of electronic book content that includes a listing for the racing form; and allowing the user to request that the racing form be downloaded to the electronic book by selecting the listing for the racing form.

3. The method defined in claim 1 wherein the racing form is for a horse race.

4. The method defined in claim 1 further comprising providing the user with an opportunity to use the electronic book to create an electronic wager.

5. The method defined in claim 1 further comprising:

providing the user with an opportunity to use the electronic book to create an electronic wager; and providing the user with an opportunity to use the racing form to select a racetrack for the wager.

6. The method defined in claim 1 further comprising:

providing the user with an opportunity to use the electronic book to create an electronic wager; and providing the user with an opportunity to use the racing form to select a race for the wager.

7. The method defined in claim 1 further comprising using the electronic book to receive data from an interactive wagering transaction processing and subscription management system.

8. The method defined in claim 1 wherein the electronic book has a cover.

9. The method defined in claim 1 wherein the electronic book has a monochrome display and no hard drive.

10. The method defined in claim 1 further comprising using the electronic book to receive data from an electronic book server.

11. The method defined in claim 1, wherein the racing form includes information on horse owners, horse jockeys, race conditions, and past performances.

12. The method defined in claim 1 further comprising providing the user with an opportunity to request that the racing form be downloaded to the electronic book.

13. The method defined in claim 1 further comprising allowing the user to interact with the contents of the displayed racing form.

14. The method defined in claim 1 further comprising displaying additional information when the user selects an item on the on-screen option being displayed racing form.

15. The method defined in claim 1 further comprising displaying an interactive wager-creation screen for the user when the user selects an item on the on-screen option being displayed on the racing form.

16. The method defined in claim 1 further comprising:

providing additional information on the display when the user selects one of the on-screen options being displayed in the racing form.

17. The method defined in claim 1 further comprising:

providing an interactive wagering application service when the user selects one of the on-screen options being displayed in the racing form, wherein the interactive wagering application service is associate with the selection.

18. The method defined in claim 1 further comprising allowing a user to submit a wager created using the electronic book.

19. The method defined in claim 1 further comprising displaying a plurality of interactive category options on the display, wherein each category option may be used to display a different type of racing information.

20. The method defined in claim 1 wherein at least one of the on-screen options allow the user to access wager-creation functions.

21. The method defined in claim 1 further comprising:

using the electronic book to provide an associated function when the user selects one of the on-screen options.

22. The method defined in claim 1 further comprising providing racing data to the electronic book in response to a request by the user.

23. The method defined in claim 1 further comprising providing racing data to the electronic book at predetermined intervals.

24. The method defined in claim 1 further comprising providing racing data to the electronic book at user-selected intervals.

25. The method defined in claim 1, wherein racing data to be provided to the electronic book is updated, the method further comprising providing the updated racing data to the electronic book.

26. The method defined in claim 1, wherein racing data to be provided to the electronic book is updated, the method further comprising providing the updated racing data to the electronic book in response to a request from the user.

27. The method defined in claim 1, wherein racing data to be provided to the electronic book is updated, the method further comprising providing the updated racing data to the electronic book at predetermined intervals.

28. The method defined in claim 1, wherein racing data to be provided to the electronic book is updated, the method further comprising providing the updated racing data to the electronic book at user-selected intervals.

29. The method defined in claim 1, wherein racing data to be provided to the electronic book is updated, the method further comprising providing the updated racing data to the electronic book when the racing data is updated.

30. The method defined in claim 1 further comprising:

providing the user with an opportunity to adjust racing data delivery settings; and delivering the racing data to the electronic book for display as part of the racing form using the delivery settings.

31. The method defined in claim 1 further comprising displaying a racing-related news flash on the display of the electronic book.

32. The method defined in claim 1 further comprising displaying a racing-related news flash on the display of the electronic book over existing content.

33. The method defined in claim 1 further comprising providing real-time reports to the electronic book based on the user's preferences.

34. The method defined in claim 1 further comprising providing real-time reports to the user based on the user's monitored activities.

35. The method defined in claim 1 further comprising displaying information with the electronic book that is related to the user's monitored wagering activities.

36. The method defined in claim 1 further comprising providing racing articles in the racing form.

37. The method defined in claim 1 further comprising providing advertisements in the racing form.

38. An interactive wagering system comprising an electronic book that has a display and page navigation buttons and that is configured to:

electronically download a racing form to the electronic book over a communications path, wherein the racing form is substantially similar to a printed racing form;

display the racing form on the display of the electronic book; and provide a user with an opportunity to interact with the racing form by selecting interactive on-screen options being displayed in the racing form.

39. The system defined in claim 38 wherein the electronic book is further configured to:

provide a menu screen on the display for the user that contains a list of electronic book content that includes a listing for the racing form; and allow the user to request that the racing form be downloaded to the electronic book by selecting the listing for the racing form.

40. The system defined in claim 38 wherein the racing form is for a horse race.

41. The system defined in claim 38 wherein the electronic book is further configured to provide the user with an opportunity to use the electronic book to create an electronic wager.

42. The system defined in claim 38 wherein the electronic book is further configured to:

provide the user with an opportunity to use the electronic book to create an electronic wager; and provide the user with an opportunity to use the racing form to select a racetrack for the wager.

43. The system defined in claim 38 herein the electronic book is further configured to:

provide the user with an opportunity to use the electronic book to create an electronic wager; and provide the user with an opportunity to use the racing form to select a race for the wager.

44. The system defined in claim 38 wherein the electronic book is further configured to receive data from an interactive wagering transaction processing and subscription management system.

45. The system defined in claim 38 wherein the electronic book further comprises a cover.

46. The system defined in claim 38 wherein the electronic book further comprises a monochrome display and no hard drive.

47. The system defined in claim 38 wherein the electronic book is further configured to receive data from an electronic book server.

48. The system defined in claim 38, wherein the racing form includes information on horse owners, horse jockeys, race conditions, and past performances.

49. The system defined in claim 38 wherein the electronic book is further configured to provide the user with an opportunity to request that the racing form be downloaded to the electronic book.

50. The system defined in claim 38 wherein the electronic book is further configured to allow the user to interact with the contents of the displayed racing form.

51. The system defined in claim 38 wherein the electronic book is further configured to display additional information when the user selects an item on the displayed racing form.

52. The system defined in claim 38 wherein the electronic book is further configured to display an interactive wager-creation screen for the user when the user selects an item on the displayed racing form.

53. The system defined in claim 38 wherein the electronic book is further configured to:

provide additional information on the display when the user selects one of the on-screen options being displayed in the racing form.

54. The system defined in claim 38 wherein the electronic book is further configured to:

provide an interactive wagering application service when the user selects one of the on-screen options being displayed in the racing form, wherein the interactive wagering application service is associated with the selection.

55. The system defined in claim 38 wherein the electronic book is further configured to allow a user to submit a wager created using the electronic book.

56. The system define in claim 38 wherein the electronic book is further configured to display a plurality of interactive category options on the display, wherein each category option may be used to display a different type of racing information.

57. The system defined in claim 38 wherein at least one of the on-screen options being displayed on the racing form allows the user to access wager-creation functions.

58. The system defined in claim 38 wherein the electronic book is further configured to:

provide an associated function when the user selects one of the on-screen options.

59. The system defined in claim 38 further comprising computer equipment that is configured to provide racing data to the electronic book in response to a request by the user.

60. The system defined in claim 38 further comprising computer equipment that is configured to provide racing data to the electronic book at predetermined intervals over a communications path.

61. The system defined in claim 38 further comprising computer equipment that is configured to provide racing data to the electronic book at user-selected intervals.

62. The system defined in claim 38, wherein racing data to be provided to the electronic book is updated, the system further comprising computer equipment configured to provide the updated racing data to the electronic book.

63. The system defined in claim 38, wherein racing data to be provided to the electronic book is updated, the system further comprising computer equipment configured to provide the updated racing data to the electronic book in response to a request from the user.

64. The system defined in claim 38, wherein racing data to be provided to the electronic book is updated, the system further comprising computer equipment configured to provide the updated racing data to the electronic book at predetermined intervals.

65. The system defined in claim 38, wherein racing data to be provided to the electronic book is updated, the system further comprising computer equipment configured to provide the updated racing data to the electronic book at user-selected intervals.

66. The system defined in claim 38, wherein racing data to be provided to the electronic book is updated, the system further comprising computer equipment configured to provide the updated racing data to the electronic book when the racing data is updated.

67. The system defined in claim 38 wherein the electronic book is further configured to provide the user with an opportunity to adjust racing data delivery settings and wherein the system further comprises computer equipment that is configured to deliver the racing data to the electronic book for display as part of the racing form using the delivery settings.

68. The system defined in claim 38 wherein the electronic book is further configured to display a racing-related news flash on the display of the electronic book.

69. The system defined in claim 38 wherein the electronic book is further configured to display a racing-related news flash on the display of the electronic book over existing content.

70. The system defined in claim 38 further comprising computer equipment that is configured to provide real-time reports to the electronic book based on the user's preferences.

71. The system defined in claim 38 wherein the electronic book is further configured to provide real-time reports to the user based on the user's monitored activities.

72. The system defined in claim 38 wherein the electronic book is further configured to display information that is related to the user's monitored wagering activities.

73. The system defined in claim 38 wherein the electronic book displays racing articles in the racing form.

74. The system defined in claim 38 wherein the electronic book displays advertisements in the racing form.

75. A computer readable medium encoded with machine-readable instructions for use in an electronic book, the machine-readable instructions comprising:

electronically downloading a racing form to the electronic book over a communications path, wherein the racing form is substantially similar to a printed racing form;

displaying the racing form on a display of the electronic book; and providing a user with an opportunity to interact with the racing form by selecting interactive on-screen options being displayed in the racing form.

76. The computer readable medium defined in claim 75, the machine-readable instructions further comprising:

providing a menu screen for the user that contains a list of electronic book content that includes a listing for the racing form; and providing the user with an opportunity to request that the racing form be downloaded to the electronic book by selecting the listing for the racing form.

77. The computer readable medium defined in claim 75 wherein the racing form is for a horse race.

78. The computer readable medium defined in claim 75, the machine-readable instructions further comprising providing the user with an opportunity to use the electronic book to create an electronic wager.

79. The computer readable medium defined in claim 75, the machine-readable instructions further comprising:

providing the user with an opportunity to use the electronic book to create an electronic wager; and providing the user with an opportunity to use the racing form to select a racetrack for the wager.

80. The computer readable medium defined in claim 75, the machine-readable instructions further comprising:

providing the user with an opportunity to use the electronic book to create an electronic wager; and providing the user with an opportunity to use the racing form to select a race for the wager.

81. The computer readable medium defined in claim 75, the machine-readable instructions further comprising enabling the electronic book to receive data from an interactive wagering transaction processing and subscription management system.

82. The computer readable medium defined in claim 75, the machine-readable instructions further comprising enabling the electronic book to receive data from an electronic book server.

83. The computer readable medium defined in claim 75 wherein the racing form includes information on horse owners, horse jockeys, race conditions, and past performances.

84. The computer readable medium defined in claim 75, the machine-readable instructions further comprising providing the user with an opportunity to request that the racing form be downloaded to the electronic book.

85. The computer readable medium defined in claim 75, the machine-readable instructions further comprising providing the user with an opportunity to interact with the contents of the displayed racing form.

86. The computer readable medium defined in claim 75, the machine-readable instructions further comprising displaying additional information when the user selects an item on the displayed racing form.

87. The computer readable medium defined in claim 75, the machine-readable instructions further comprising displaying an interactive wager-creation screen for the user when the user selects an item on the displayed racing form.

88. The computer readable medium defined in claim 75, the machine-readable instructions further comprising:

providing additional information on the display when the user selects one of the on-screen options being displayed in the racing form.

89. The computer readable medium defined in claim 75, the machine-readable instructions further comprising:

providing an interactive wagering application service when the user selects one of the on-screen options being displayed in the racing form, wherein the interactive wagering application service is associated with the selection.

90. The computer readable medium defined in claim 75, the machine-readable instructions further comprising providing the user with an opportunity to submit a wager created using the electronic book.

91. The computer readable medium defined in claim 75, the machine-readable instructions further comprising displaying a plurality of interactive category options on the display, wherein each category option may be used to display a different type of racing information.

92. The computer readable medium defined in claim 75, wherein at least one of the on-screen options allow the user to access wager-creation functions.

93. The computer readable medium defined in claim 75, the machine-readable instructions further comprising:

enabling the electronic book to provide an associated function when the user selects one of the on-screen options.

94. The computer readable medium defined in claim 75, the machine-readable instructions further comprising providing racing data to the electronic book in response to a request by the user.

95. The computer readable medium defined in claim 75, the machine-readable instructions further comprising providing racing data to the electronic book at predetermined intervals.

96. The computer readable medium defined in claim 75, the machine-readable instructions further comprising providing racing data to the electronic book at user-selected intervals.

97. The computer readable medium defined in claim 75, wherein racing data to be provided to the electronic book is updated, the machine-readable instructions further comprising providing the updated racing data to the electronic book.

98. The computer readable medium defined in claim 75, wherein racing data to be provided to the electronic book is updated, the machine-readable instructions further comprising providing the updated racing data to the electronic book in response to a request from the user.

99. The computer readable medium defined in claim 75, wherein racing data to be provided to the electronic book is updated, the machine-readable instructions further comprising providing the updated racing data to the electronic book at predetermined intervals.

100. The computer readable medium defined in claim 75, wherein racing data to be provided to the electronic book is updated, the machine-readable instructions further comprising providing the updated racing data to the electronic book at user-selected intervals.

101. The computer readable medium defined in claim 75, wherein racing data to be provided to the electronic book is updated, the machine-readable instructions further comprising providing the updated racing data to the electronic book when the racing data is updated.

102. The computer readable medium defined in claim 75, the machine-readable instructions further comprising:

providing the user with an opportunity to adjust racing data delivery settings; and providing the racing data to the electronic book for display as part of the racing form using the delivery settings.

103. The computer readable medium defined in claim 75, the machine-readable instructions further comprising displaying a racing-related news flash on the display of the electronic book.

104. The computer readable medium defined in claim 75, the machine-readable instructions further comprising displaying a racing-related news flash on the display of the electronic book over existing content.

105. The computer readable medium defined in claim 75, the machine-readable instructions further comprising providing real-time reports to the electronic book based on the user's preferences.

106. The computer readable medium defined in claim 75, the machine-readable instructions further comprising providing real-time reports to the user based on the user's monitored activities.

107. The computer readable medium defined in claim 75, the machine-readable instructions further comprising displaying information with the electronic book that is related to the user's monitored wagering activities.

108. The computer readable medium defined in claim 75, the machine-readable instructions further comprising providing racing articles in the racing form.

109. The computer readable medium defined in claim 75, the machine-readable instructions further comprising providing advertisements in the racing form.

110. An interactive wagering system comprising an electronic book that has a display and page navigation buttons, the system comprising:

means for electronically downloading a racing form to the electronic book over a communications path, wherein the racing form is substantially similar to a printed racing form;

means for displaying the racing form on the display of the electronic book; and means for providing a user with an opportunity to interact with the racing form by selecting interactive on-screen options being displayed in the racing form.

111. The system defined in claim 110 further comprising:

means for providing a menu screen for the user that contains a list of electronic book content that includes a listing for the racing form; and means for allowing the user to request that the racing form be downloaded to the electronic book by selecting the listing for the racing form.

112. The system defined in claim 110 wherein the racing form is for a horse race.

113. The system defined in claim 110 further comprising means for providing the user with an opportunity to use the electronic book to create an electronic wager.

114. The system defined in claim 110 further comprising:

means for providing the user with an opportunity to use the electronic book to create an electronic wager; and means for providing the user with an opportunity to use the racing form to select a racetrack for the wager.

115. The system defined in claim 110 further comprising:

means for providing the user with an opportunity to use the electronic book to create an electronic wager; and means for providing the user with an opportunity to use the racing form to select a race for the wager.

116. The system defined in claim 110 further comprising means for using the electronic book to receive data from an interactive wagering transaction processing and subscription management system.

117. The system defined in claim 110 further comprising means for using the electronic book to receive data from an electronic book server.

118. The system defined in claim 110, wherein the racing form includes information on horse owners, horse jockeys, race conditions, and past performances.

119. The system defined in claim 110 further comprising means for providing the user with an opportunity to request that the racing form be downloaded to the electronic book.

120. The system defined in claim 110 further comprising means for allowing the user to interact with the contents of the displayed racing form.

121. The system defined in claim 110 further comprising means for displaying additional information when the user selects an item on the displayed racing form.

122. The system defined in claim 110 further comprising means for displaying an interactive wager-creation screen for the user when the user selects an item on the displayed racing form.

123. The system defined in claim 110 further comprising:

means for providing additional information on the display when the user selects one of the on-screen options being displayed in the racing form.

124. The system defined in claim 110 further comprising:

means for providing an interactive wagering application service when the user selects one of the on-screen options being displayed in the racing form, wherein the interactive wagering application service is associated with the selection.

125. The system defined in claim 110 further comprising means for allowing a user to submit a wager created using the electronic book.

126. The system defined in claim 110 further comprising means for displaying a plurality of interactive category options on the display, wherein each category option may be used to display a different type of racing information.

127. The system defined in claim 110 wherein at least one of the on-screen options allow the user to access wager-creation functions.

128. The system defined in claim 110 further comprising:

means for using the electronic book to provide an associated function when the user selects one of the on-screen options.

129. The system defined in claim 110 further comprising means for providing racing data to the electronic book in response to a request by the user.

130. The system defined in claim 110 further comprising means for providing racing data to the electronic book at predetermined intervals.

131. The system defined in claim 110 further comprising means for providing racing data to the electronic book at user-selected intervals.

132. The system defined in claim 110, wherein racing data to be provided to the electronic book is updated, the system further comprising means for providing the updated racing data to the electronic book.

133. The system defined in claim 110, wherein racing data to be provided to the electronic book is updated, the system further comprising means for providing the updated racing data to the electronic book in response to a request from the user.

134. The system defined in claim 110, wherein racing data to be provided to the electronic book is updated, the system further comprising means for providing the updated racing data to the electronic book at predetermined intervals.

135. The system defined in claim 110, wherein racing data to be provided to the electronic book is updated, the system further comprising means for providing the updated racing data to the electronic book at user-selected intervals.

136. The system defined in claim 110, wherein racing data to be provided to the electronic book is updated, the system further comprising means for providing the updated racing data to the electronic book when the racing data is updated.

137. The system defined in claim 110 further comprising:

means for providing the user with an opportunity to adjust racing data delivery settings; and means for delivering the racing data to the electronic book for display as part of the racing form using the delivery settings.

138. The system defined in claim 110 further comprising means for displaying a racing-related news flash on the display of the electronic book.

139. The system defined in claim 110 further comprising means for displaying a racing-related news flash on the display of the electronic book over existing content.

140. The system defined in claim 110 further comprising means for providing real-time reports to the electronic book based on the user's preferences.

141. The system defined in claim 110 further comprising means for providing real-time reports to the user based on the user's monitored activities.

142. The system defined in claim 110 further comprising means for displaying information with the electronic book that is related to the user's monitored wagering activities.

143. The system defined in claim 110 further comprising means for providing racing article s in the racing form.

144. The system defined in claim 110 further comprising means for providing advertisements in the racing form.

* * * * *

UNITED STATES PATENT AND TRADEMARK OFFICE

CERTIFICATE OF CORRECTION

PATENT NO. : 6,712,701 B1
APPLICATION NO. : 09/642967
DATED : March 30, 2004
INVENTOR(S) : Peter C. Boylan, III et al.

It is certified that error appears in the above-identified patent and that said Letters Patent is hereby corrected as shown below:

Column 2, lines 34-36, replace the paragraph beginning with “FIG. 6” and ending with “invention” with --FIG 6A shows the top half of an illustrative racing form that may be displayed using an electronic book in accordance with the present invention.

FIG. 6B shows that bottom half of an illustrative racing form that may be displayed using an electronic book in accordance with the present invention.--

Column 5, lines 20-21, delete second occurrence of “such as”.

Column 8, line 48, replace “be” with --by--.

Column 15, line 63, replace “6” with --6A and FIG. 6B--.

Column 16, line 1, replace “6” with --6A and FIG. 6B--.

Column 16, line 5, replace “6” with --6A and FIG. 6B--.

Column 16, line 6, replace “6” with --6A and FIG. 6B--.

Column 16, line 28, replace “6” with --6A--.

Column 18, line 25, replace “6” with --6A and FIG. 6B--.

Column 18, line 52, replace “6” with --6A and FIG. 6B--.

Column 19, line 35, insert --be-- after “may”.

Column 19, line 58, change “user’s” to --users--.

Column 21, line 59, change “associate” to --associated--.

Column 24, line 7, change “define” to --defined--.

UNITED STATES PATENT AND TRADEMARK OFFICE

CERTIFICATE OF CORRECTION

PATENT NO. : 6,712,701 B1
APPLICATION NO. : 09/642967
DATED : March 30, 2004
INVENTOR(S) : Peter C. Boylan, III et al.

It is certified that error appears in the above-identified patent and that said Letters Patent is hereby corrected as shown below:

Column 30, line 23, change “article s” to --articles--.

Signed and Sealed this

Twenty-second Day of January, 2008

JON W. DUDAS
*Director of the United States Patent and Trademark Office*